US008056224B2

(12) United States Patent
Peng

(10) Patent No.: US 8,056,224 B2
(45) Date of Patent: Nov. 15, 2011

(54) METHOD OF MANUFACTURING A NETWORK JACK

(76) Inventor: John Peng, Shenkeng Township (TW)

( * ) Notice: Subject to any disclaimer, the term of this patent is extended or adjusted under 35 U.S.C. 154(b) by 235 days.

(21) Appl. No.: 12/358,075

(22) Filed: Jan. 22, 2009

(65) Prior Publication Data

US 2009/0124137 A1 May 14, 2009

Related U.S. Application Data

(63) Continuation-in-part of application No. 11/724,356, filed on Mar. 14, 2007, now Pat. No. 7,498,529.

(30) Foreign Application Priority Data

May 19, 2006 (TW) ..... 95117989 A
Nov. 7, 2006 (TW) ..... 95141223 A

(51) Int. Cl.
*H01R 43/04* (2006.01)

(52) U.S. Cl. ..... 29/882; 29/829; 29/844

(58) Field of Classification Search ..... 29/882, 29/829, 843, 844, 878, 739; 439/76.1, 557, 439/620.07, 676, 736, 941; 257/726, 727, E23.099, E23.103

See application file for complete search history.

(56) References Cited

U.S. PATENT DOCUMENTS 6,276,971 B1 * 8/2001 Belopolsky ..... 439/676
6,861,747 B2 * 3/2005 Miyazaki et al. ..... 257/718

* cited by examiner

*Primary Examiner* — Thiem Phan
(74) *Attorney, Agent, or Firm* — Haverstock & Owens

(57) ABSTRACT

A method for manufacturing a network jack is provided. The method includes steps of: a) providing a circuit board having a first side, plural first contacting areas along the first side, plural second contacting areas and an upper and a lower surfaces; (b) forming first bendable contacts on the plural first contacting areas by using a first riveting process; (c) forming second bendable contacts on the plural second contacting areas by using a second riveting process; and (d) bending each of the second bendable contacts by assembling an acting portion on the circuit board to make the second bendable contacts have at least two arranged directions, wherein the first bendable contacts and the second bendable contacts contact with an external plug and are fixed to the circuit board of the network jack by the first and the second riveting processes.

8 Claims, 30 Drawing Sheets

METHOD OF MANUFACTURING A NETWORK JACK

FIELD OF THE INVENTION

The present invention is a CIP application of the parent application "Network Jack And Manufacturing Method Therefor" bearing on the Ser. No. 11/724,356 and filed on Mar. 14, 2007 now U.S. Pat. No. 7,498,529. The present invention relates to the network jack and the manufacturing method therefor, and more particular to that the contacts of the network jack are fixed to the circuit board of the network jack by a riveting process and the manufacturing method therefor.

BACKGROUND OF THE INVENTION

In general, a network jack is applied to connect the computer to the internet. The conventional network jack has eight wire pins to electrically connect with the eight wires of a jumper.

Please refer to FIG. 1, which shows a diagram of the circuit board disclosed in FIG. 13 of U.S. Pat. No. 6,749,466 B1. As shown in FIG. 1, the circuit board 10 has four pairs of contacts 13, 14, 15, and 16 mounted thereon. The pair of contact 13 has a first contact 131 and a second contact 132, the pair of contact 14 has a third contact 141 and a fourth contact 142, the pair of contact 15 has a fifth contact 151 and a sixth contact 152, and the pair of contact 16 has a seventh contact 161 and an eighth contact 162. The first contact 131, the second contact 132, the third contact 141, the fourth contact 142, the fifth contact 151 and the sixth contact 152 are arranged on the first, second third, fourth, fifth and sixth positions 1311, 1321, 1411, 1421, 1511 and 1521, which are on the same line L1 along the short-side 102 and perpendicular to the long-side 101, and the seventh contact 161 and the eighth contact 162 are arranged on the seventh and eighth positions 1616 and 1621, which are arranged on another line L2. It is to be noted that in order to simplify the similar illustrations for contacts 131, 132, 141, 142, 151, 152, 161 and 162, only the illustration for the seventh contact 161 is described hereinafter. The seventh contact 161 has a fasten end 1611 and a free end 1612.

The network jack disclosed in U.S. Pat. No. 6,749,466 and other network jacks have some disadvantages. For example, the distance between the two contacts of the same pair of contacts is too small, so that the network jack could not afford the operating voltage higher than 800 volts. In addition, it is necessary to provide a push foot 1613 on the fasten end 1611 of the seventh contact 161 to mount the seventh contact 161. Furthermore, the contacts in U.S. Pat. No. 6,749,466 are rectangular so that their flexibilities are not so good. Moreover, the conventional contacts are made of beryllium copper, which is a high-cost material. Additionally, the conventional contacts are formed by a punch and then mounted into the circuit board. Taking the seventh contact 161 as an example, after the seventh contact 161 is mounted onto the circuit board 10 with the push foot 1613, the seventh contact 161 would be bent by a machine so as to form the three bending portions 1614, 1615 and 1616. As above, the conventional manufacturing process of the network jack is complex. In addition, the contacts of some conventional network jacks are arranged randomly, such as the contacts shown in FIG. 16 of U.S. Pat. No. 6,749,466, so that it is difficult to assemble the relevant network jacks.

As mentioned above, a network jack and the relevant manufacturing method are thus highly desired if they are able to overcome the drawbacks of the conventional network jack, such as the narrow operating voltage range, the high cost, the complex manufacturing process and the delicate assembling required.

SUMMARY OF THE INVENTION

In accordance with an aspect of the present invention, a method for manufacturing a network jack is provided. The method includes the steps of: a) providing a circuit board having a first side, a plurality of first contacting areas along the first side, a plurality of second contacting areas and an upper and a lower surfaces, wherein the plurality of first contacting areas are located between the plurality of second contacting areas and the first side; b) upwardly configuring a plurality of first contacts into the plurality of first contacting areas from the lower surface toward the upper surface to protrude the first contacts from the upper surface; and c) upwardly configuring a plurality of second contacts into the plurality of second contacting areas from the lower surface to the upper surface to protrude the second contacts from the upper surface.

Preferably, the first side and each of the plurality of second contacting areas have a respective distance therebetween and the respective distances different from one another.

Preferably, the method further includes a step d) of bending the second contacts to make each of which have at least one bend.

Preferably, the second contacts are bent toward respective directions being different from one another.

Preferably, the method further includes a step e) of mounting an assembly on the circuit board for bending the second contacts to make each of which have at least a specific direction.

Preferably, the method further includes a step f) of bending the first contacts.

Preferably, the steps b) and c) are performed by a riveting process.

Preferably, the first and the second contacts contact with an external plug.

In accordance with a further respect of the present application, a network jack is provided. The network jack includes a circuit board having an upper and a lower surfaces; and a plurality of contacts upwardly inserted into the circuit board from the upper surface toward the lower surface and protruding from the upper surface.

Preferably, the circuit board has at least one contacting area where the plurality of contacts are inserted thereto.

Preferably, the network jack further includes an acting portion mounted on the circuit board and bending at least one of the plurality of contacts.

Preferably, the plurality of contacts are cylindrical ones.

Preferably, the circuit board has a first side, a plurality of first areas along the first side and a plurality of second areas, the plurality of contacts have first and second contacts respectively inserted into the plurality of first and the plurality of second areas, the first side and each of the plurality of second areas have a respective distance therebetween and the respective distances are different from one another.

Preferably, each of the first and the second contacts has at least one bend, and the second contacts have respective directions being different from one another.

In accordance with a further respect of the present application, a method for configuring a plurality of contacts is provided. The method includes steps of: a) providing a circuit board having an upper and a lower surfaces; and b) upwardly inserting the plurality of contacts into the circuit board from the lower surface toward the upper surface to protrude the plurality of contacts from the upper surface.

Preferably, the method is used for manufacturing a network jack and further includes a step c) of bending the plurality of contacts by configuring a terminal assembly on the circuit board.

In accordance with a further respect of the present application, a method for configuring a plurality of contacts is provided. The method includes steps of: a) providing a circuit board having an upper and a lower surfaces; b) downward inserting the contact into the circuit board from the upper surface toward the lower surface to protrude a portion of the contact from the lower surface; and c) providing an upward force on the portion of contact for fixing the contact to the circuit board.

Preferably, the step c) is performed by a riveting process.

Preferably, the contact has an upper and a lower ends being opposite to each other, and the upward force is stressed on the lower end.

Preferably, the upward force is provided by a punch or a punching process.

The above contents and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 2:
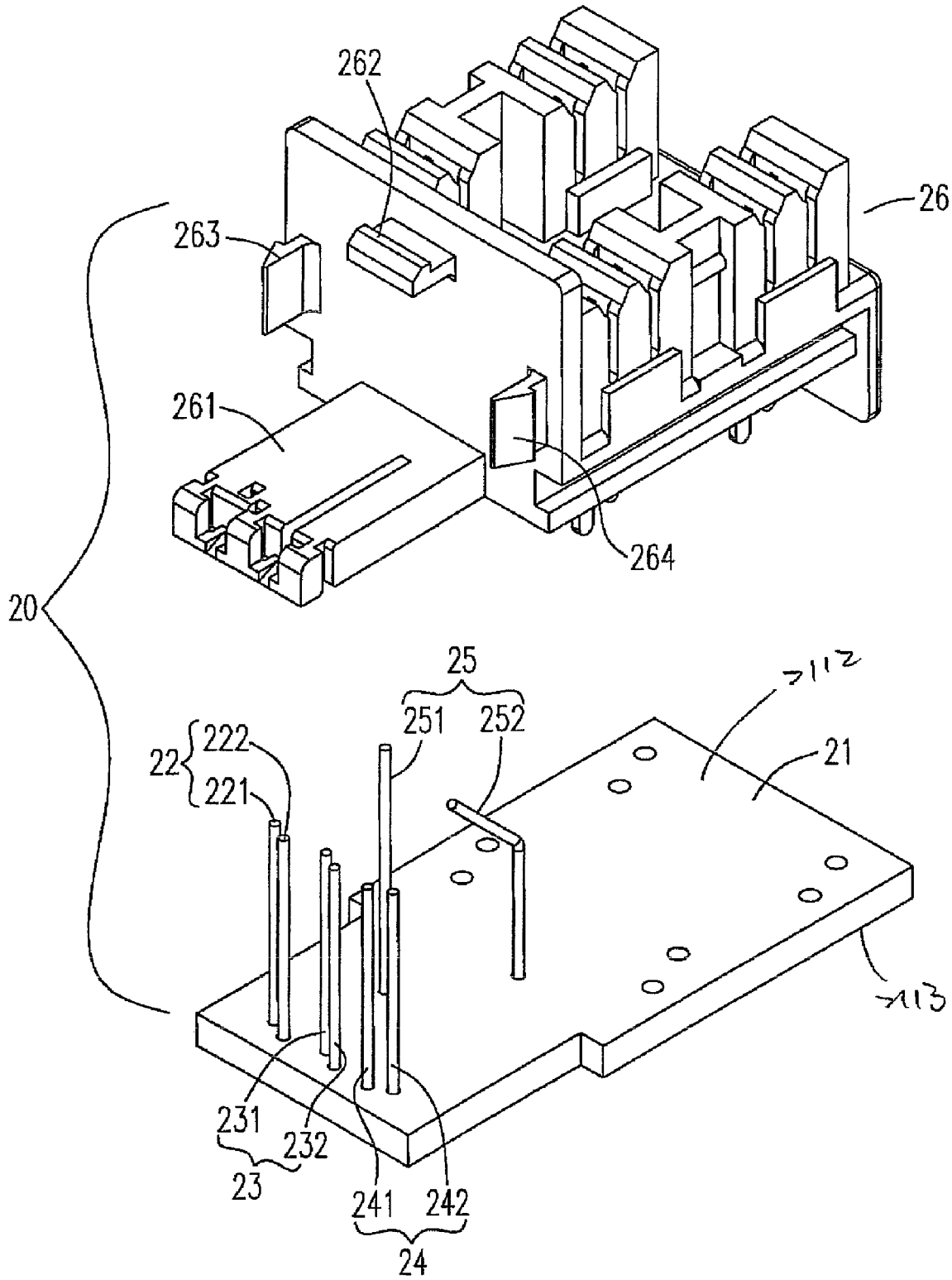
FIG. 2 shows a decomposition diagram of the network jack according to a preferred embodiment of the present invention.
Figure 3:
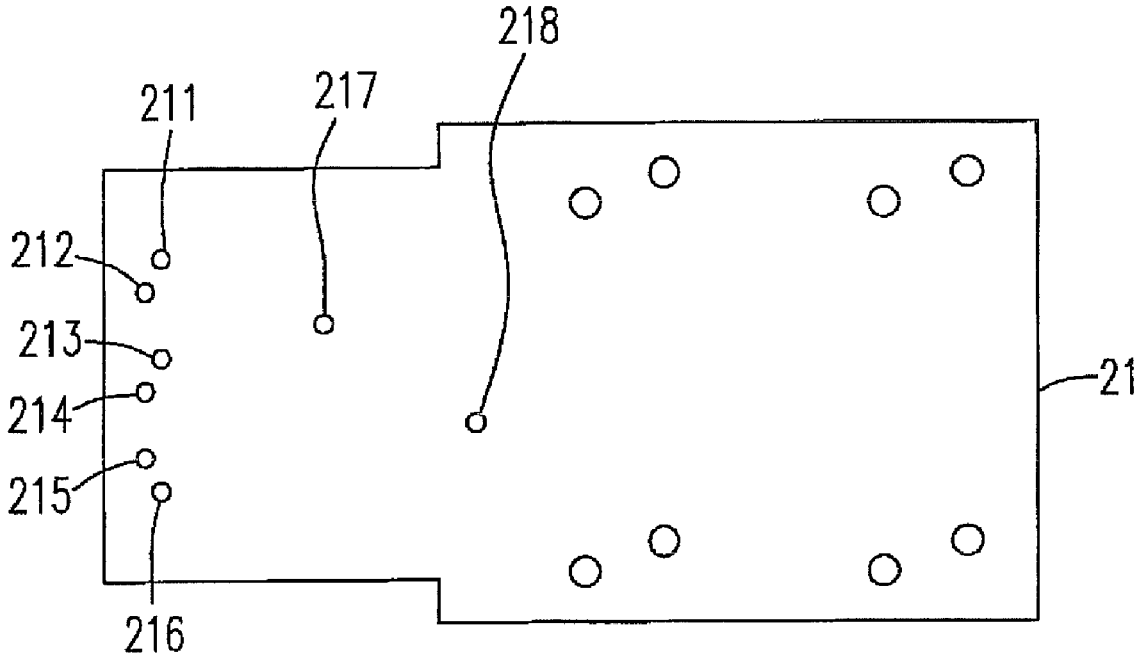
FIG. 3 shows the diagram of the printed circuit board shown in FIG. 2.

Please refer to FIGS. 2 and 3. FIG. 2 shows a decomposition diagram of the network jack according to a preferred embodiment of the present invention, and FIG. 3 shows the diagram of the printed circuit board shown in FIG. 2. The network jack 20 includes the printed circuit board 21, the first contact 221, the second contact 222, the third contact 231, the fourth contact 232, the fifth contact 241, the sixth contact 242, the seventh contact 251, the eighth contact 252, and the terminal base 26, wherein the printed circuit board 21 has an upper surface 2112 and a lower surface 2113. The terminal base 26 includes the contact frame 261, the first protrusion 262, the second protrusion 263 and the third protrusion 264. The first and second contacts 221 and 222 form a first contact pair 22, the third contact 231 and the fourth contact 232 form a second contact pair 23, the fifth contact 241 and the sixth contact 242 form a third contact pair 24, and the seventh contact 251 and the eighth contact 252 form the fourth contact pair 25. As shown in FIG. 3, the printed circuit board 21 has the first location point 211, the second location point 212, the third location point 213, the fourth location point 214, the fifth location point 215, the sixth location point 216, the seventh location point 217 and the eighth location point 218. As shown in FIGS. 2 and 3, the first contact 221 is mounted on the first location point 211, the second contact 222 is mounted on the second location point 212, the third contact 231 is mounted on the third location point 213, the fourth contact 232 is mounted on the fourth location point 214, the fifth contact 241 is mounted on the fifth location point 215, the sixth contact 242 is mounted on the sixth location point 216, the seventh contact 251 is mounted on the seventh location point 217, and the eight contact 252 is mounted on the eight location point 218.

Please refer to FIG. 3, it is to be noted that the distance between the two contacts respectively mounted on the location points 217 and 218 in the present application would be greater than that of the prior art, U.S. Pat. No. 6,749,466.

Accordingly, the network jack 20 of the present application could be operated with the relatively higher voltage, such as 1000 volts.

Please refer to FIGS. 2 and 3, during the manufacturing process of the network jack 20, the eighth contact 252 would be provided with a predetermined bending portion 2521 after mounted on the eighth location points 217 and 218.

Figure 4A:
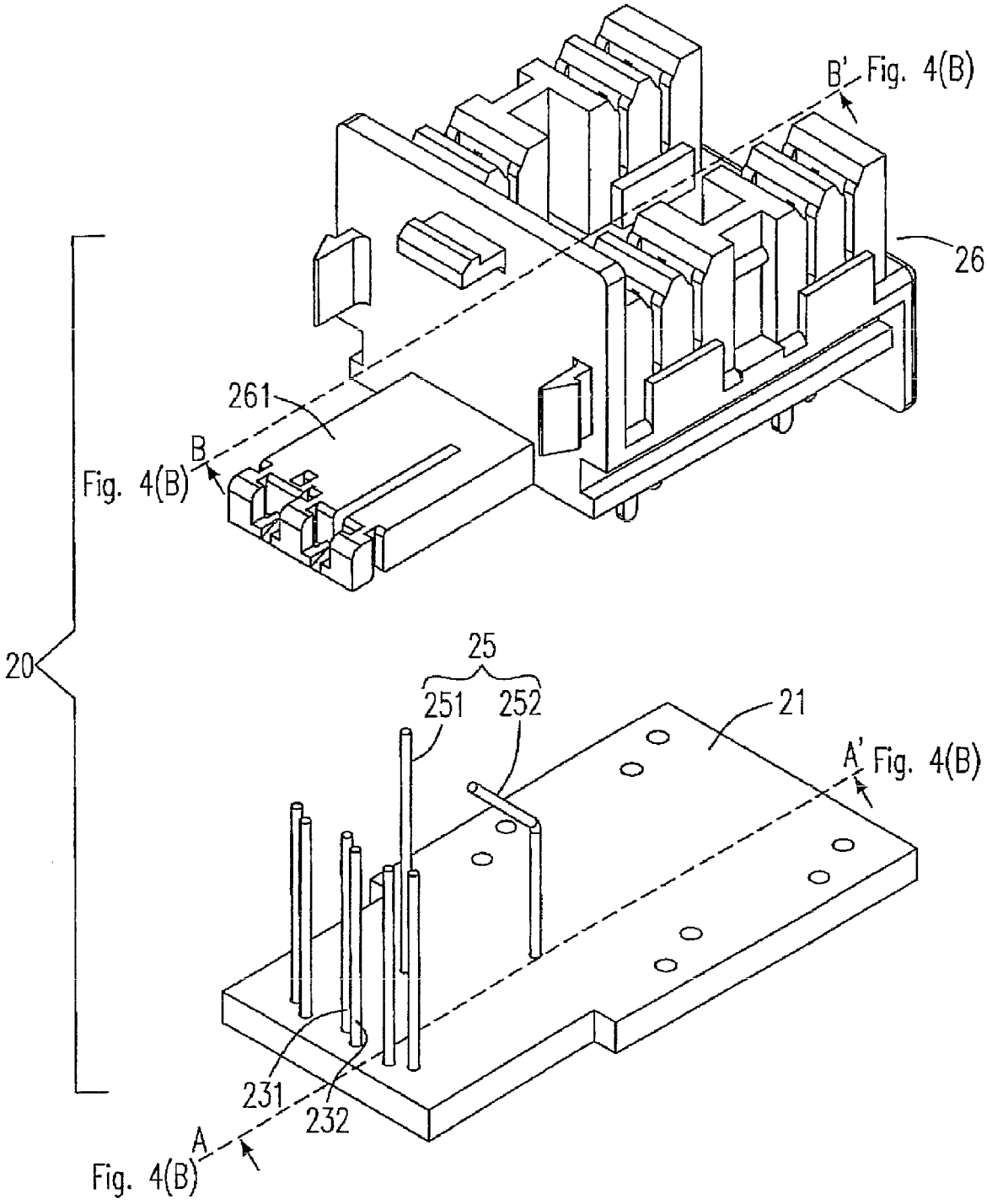
FIG. 4(A) is the diagram showing the printed circuit board and the terminal base of the present invention.
Figure 4B:
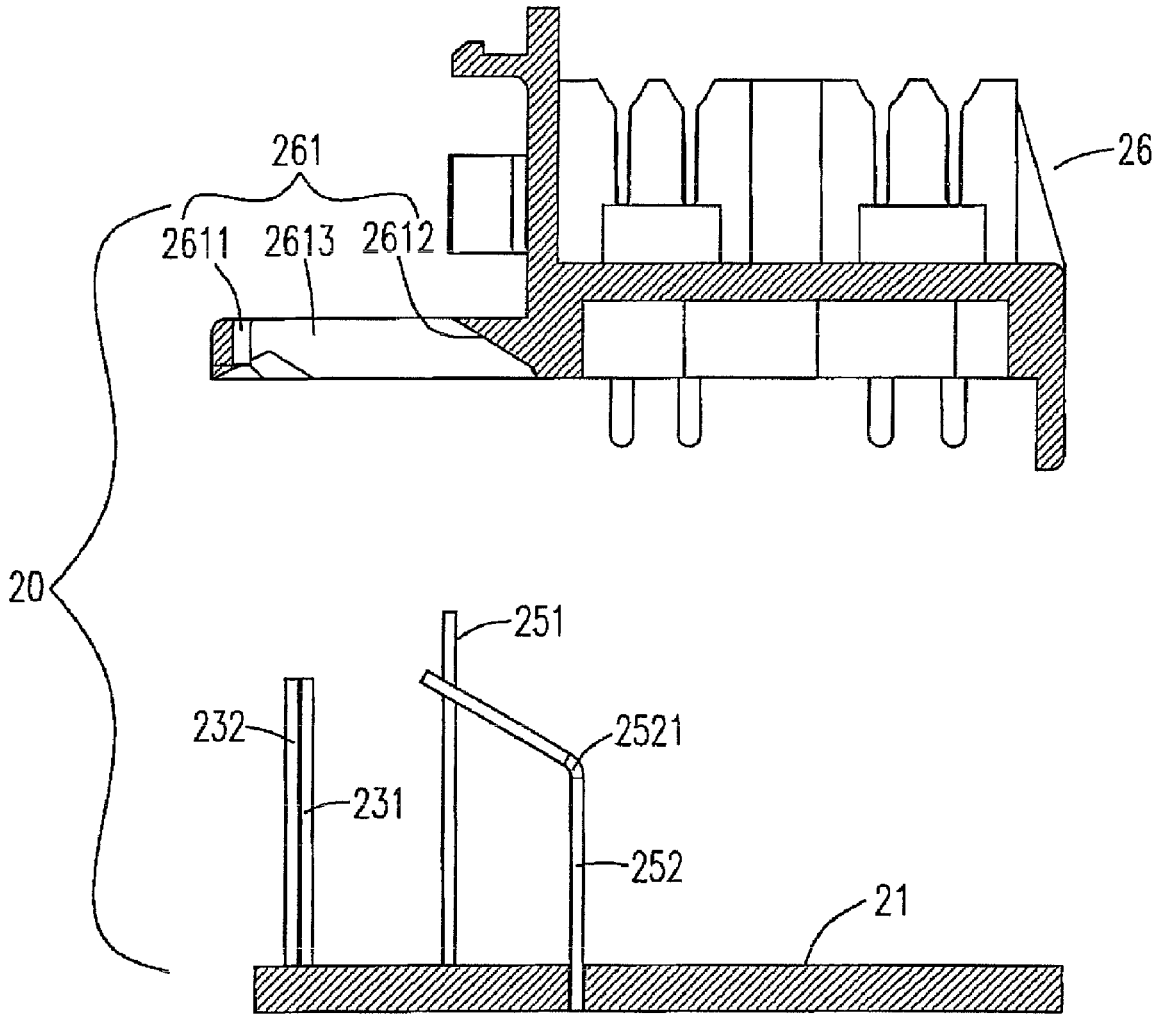
FIG. 4(B) is the diagram showing side views of the circuit board and the terminal base respectively taken along the broken lines A-A' and B-B' as shown in FIG. 4(A) according to a preferred embodiment of the present invention.
Figure 5A:
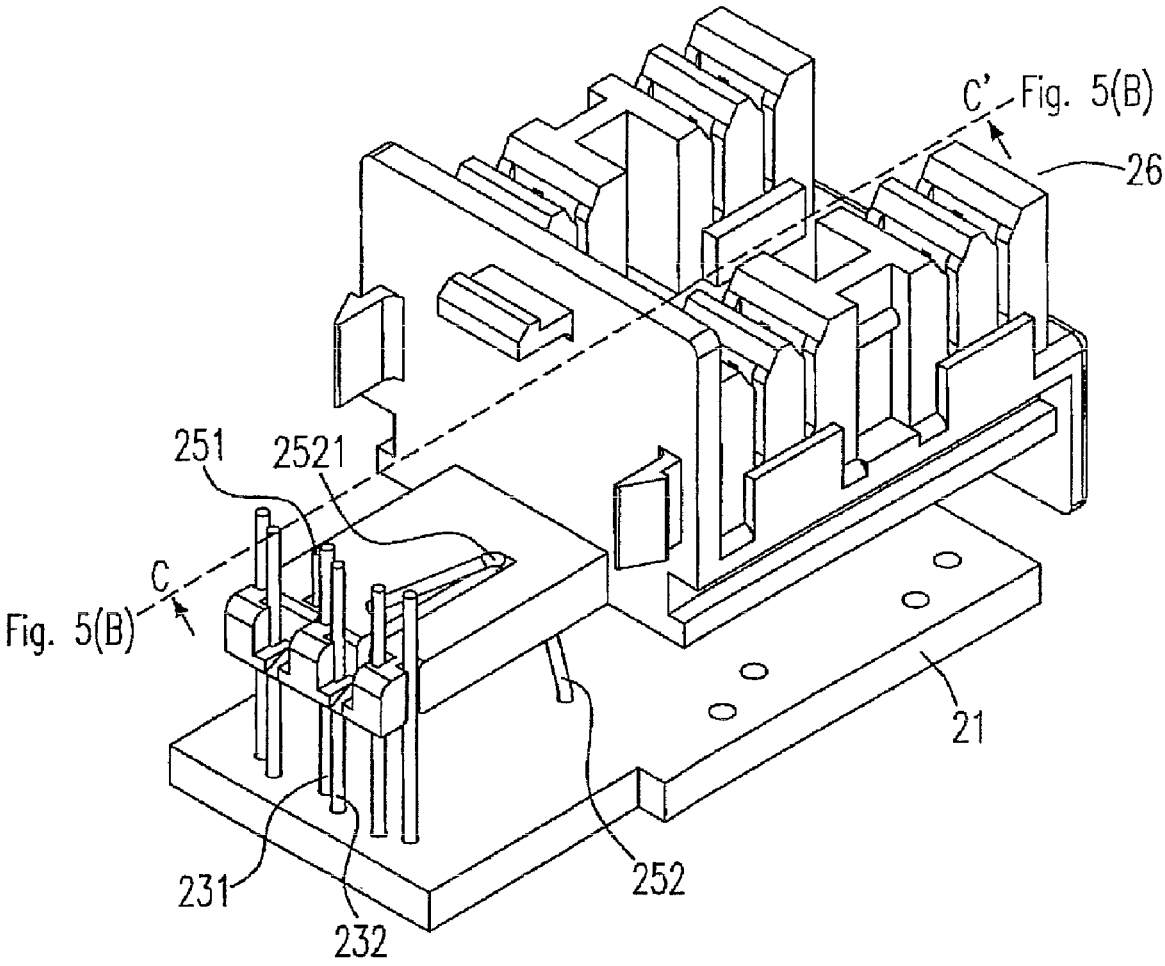
FIG. 5(A) is the diagram showing the printed circuit board partially assembled with the terminal base of the present invention.
Figure 5B:
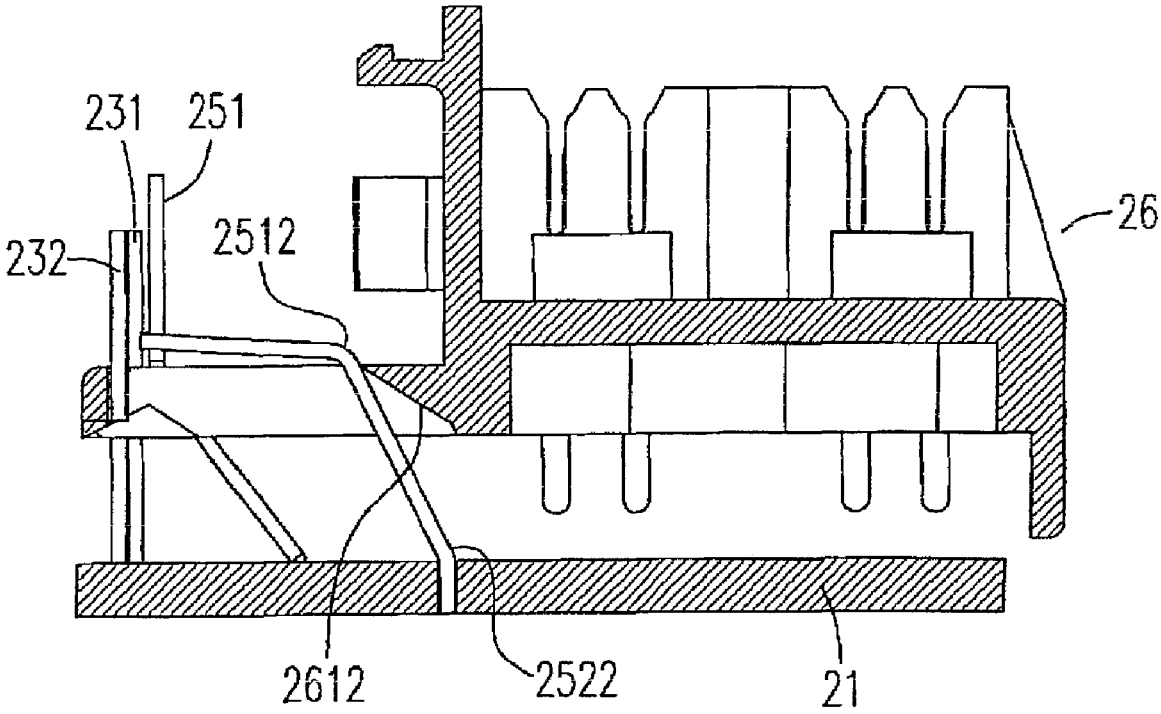
FIG. 5(B) is a diagram showing a sectional view of the circuit board partially assembled with the terminal base taken along the broken line C-C' as shown in FIG. 5(A) according to a preferred embodiment of the present invention.

Please refer to FIGS. 4(A), 4(B), 5(A) and 5(B). FIG. 4(A) is the diagram showing the printed circuit board 21 and the terminal base 26. FIG. 4(B) is the diagram showing the side views of the printed circuit board 21 and the terminal base 26, respectively taken along the broken lines A-A' and B-B' as shown in FIG. 4(A). FIG. 5(A) is the diagram showing the terminal base 26 partially combined with the printed circuit board 21. FIG. 5(B) is the diagram showing a sectional view of the circuit board partially assembled with the terminal base, taken along the broken line C-C' as shown in FIG. 5(A). As shown in FIG. 4(B), the contact frame 261 further has a frame bending portion 2612 and a tunnel 2613. The eighth contact 252 would be bent by the frame bending portion 2612 and have another bending portion 2522 (please refer to FIG. 5(B)) after the printed circuit board 21 is assembled with the terminal base 26 and the eighth contact 252 passes through the tunnel 2613. The assembling process of the printed circuit board 21 and the terminal base 26 could be found in FIGS. 4(B) and 5(B). As shown in FIG. 5(B), the eighth contact 252 would have two bending portions 2521 and 2522 after the terminal base 26 is assembled with the printed circuit board 21. The eighth contact 252 is bent by the frame bending portion 2612 and passes through the tunnel 2613.

Please refer to FIGS. 4 and 5, the contact frame 261 has plural contact openings 2611, and the first, second, third, fourth contacts (not shown therein), the fifth and sixth contacts 241 and 242 pass through the plural contact openings 2611.

Figure 6A:
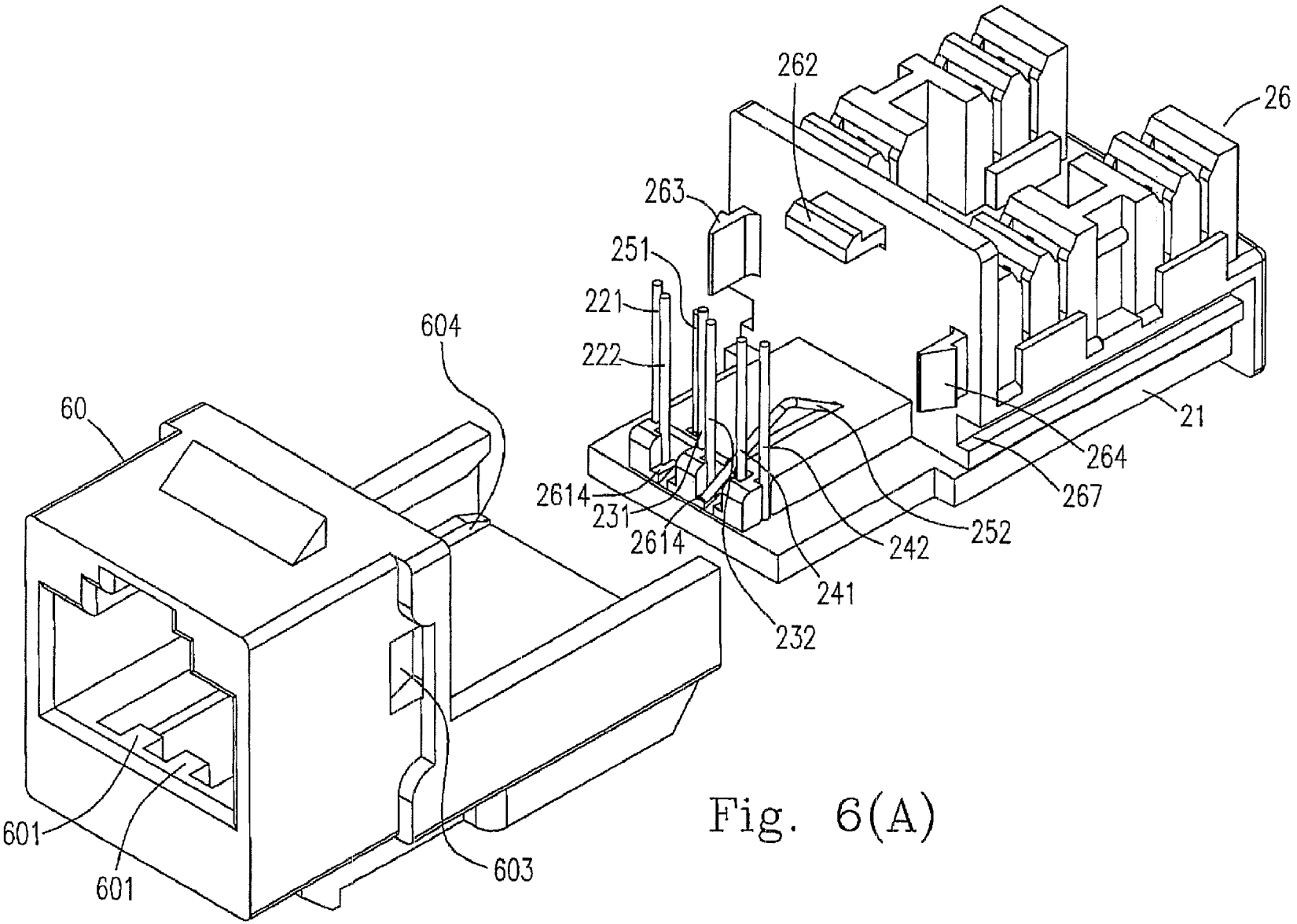
FIGS. 6(A) and 6(B) are diagrams showing the pre-assembly and post-assembly of a plug portion, the terminal base and the circuit board according to a preferred embodiment of the present invention.
Figure 6B:
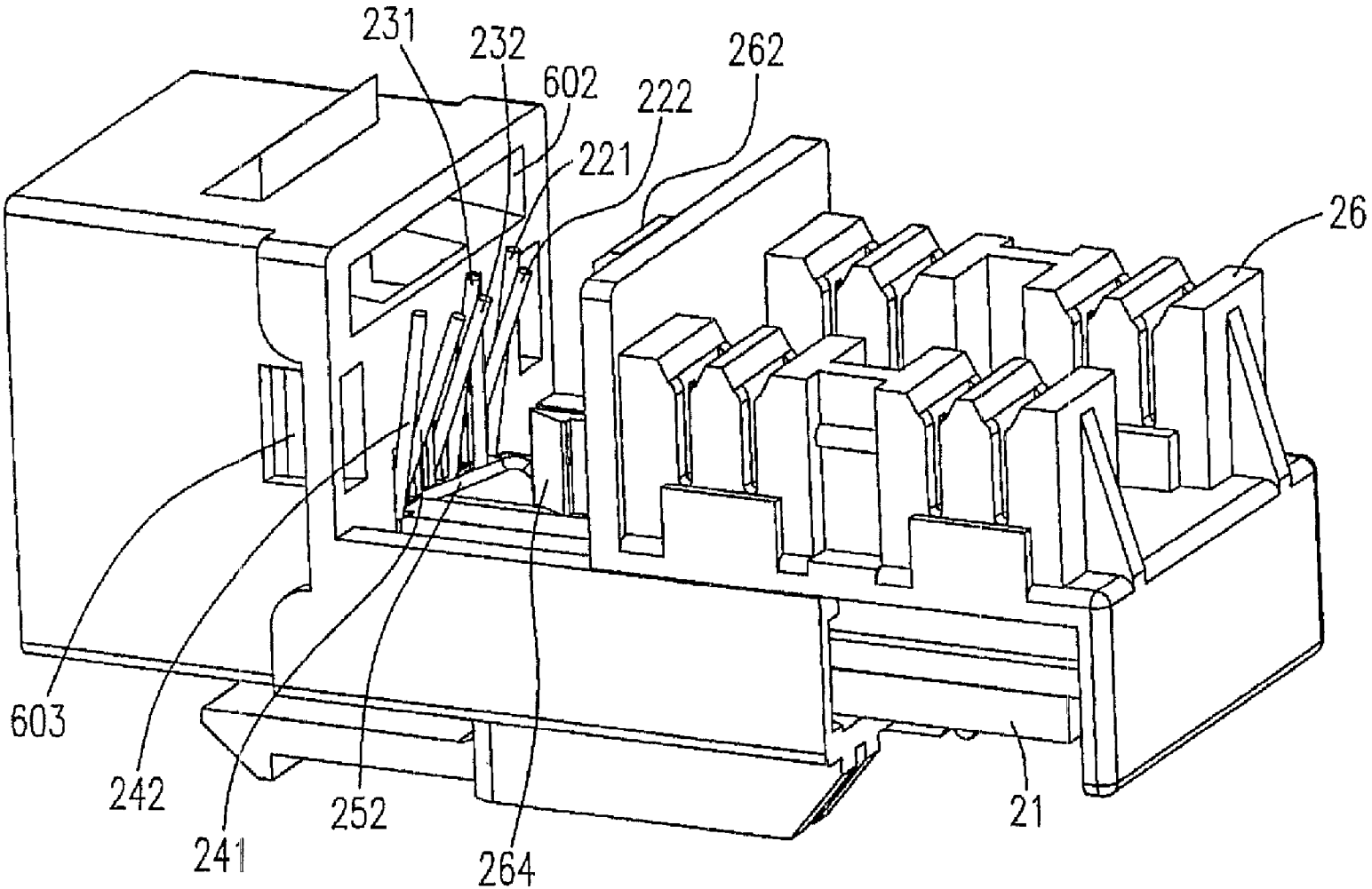

Please refer to FIGS. 6A and 6B, which are diagrams showing the assembling of a plug portion 60, the terminal base 26 and the printed circuit board 21. As shown in FIGS. 6A and 6B, the plug portion 60 includes the frame buckle 601 detachably assembled with the frame connecting portion 2614, the first connecting portion 602 to be detachably connected with the first protrusion 262, the second connecting portion 603 to be detachably connected with the third protrusion 264. The terminal base 26 has a channel 267 for containing the protrusion 604. The plug portion 60 could be assembled with the terminal base 26 via the protrusion 604 moving along the channel 267. During the assembling of the plug portion 60, the terminal base 26 and the printed circuit board 21, the first, second, third, fourth, fifth and sixth contacts 221, 222, 231, 232, 241 and 242 would be bent by the plug portion 60 (please refer to FIG. 6B). Therefore, during the manufacturing process of the present network jack 20, no specific bending machine is necessary to make the first to sixth contacts 221 to 242 bend. Accordingly, the relevant bending cost in the prior art could be saved in the present application.

Figure 7A:
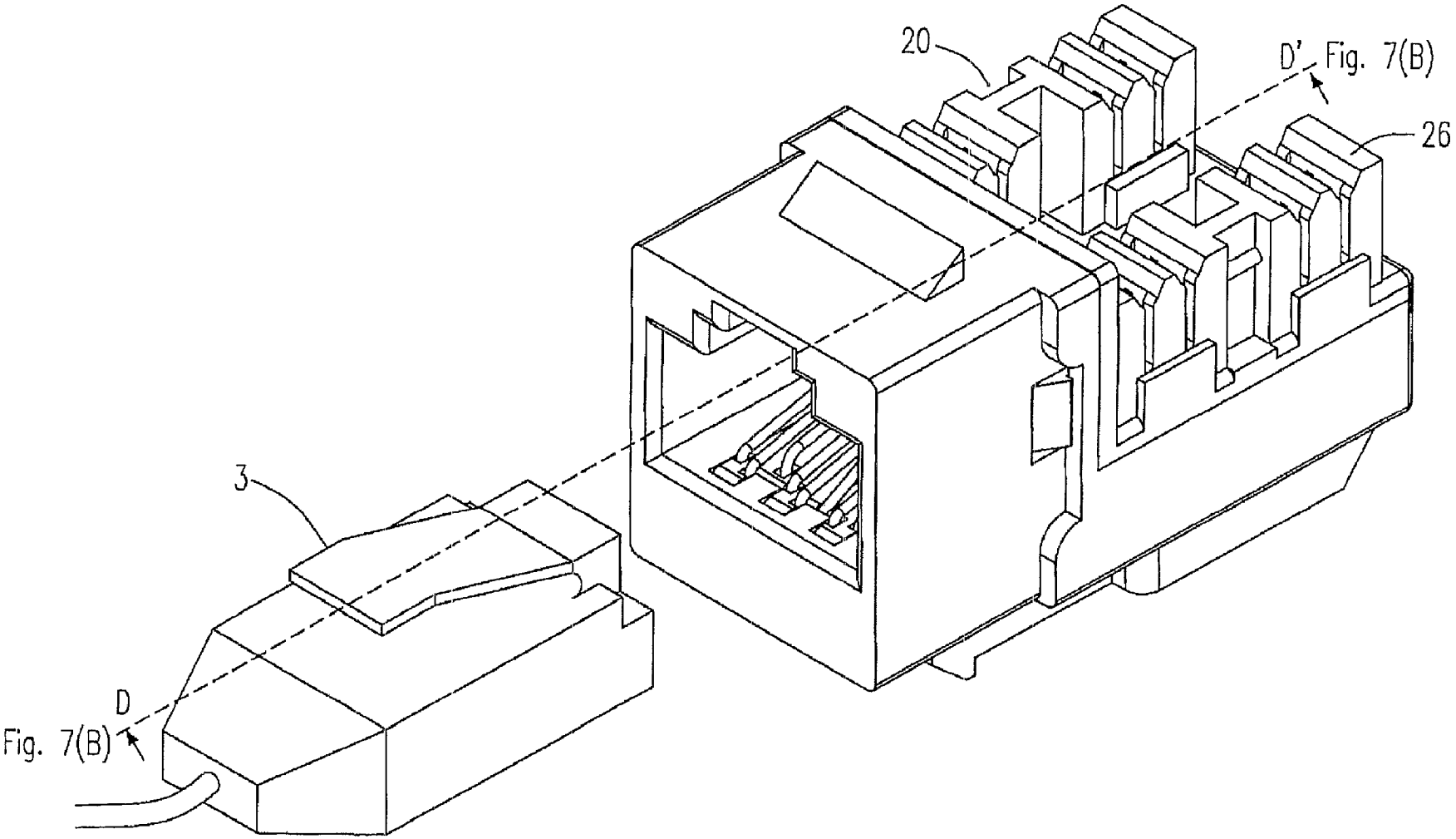
FIG. 7(A) is a diagram showing the assembled network jack 20 and the internet plug 3.
Figure 7B:
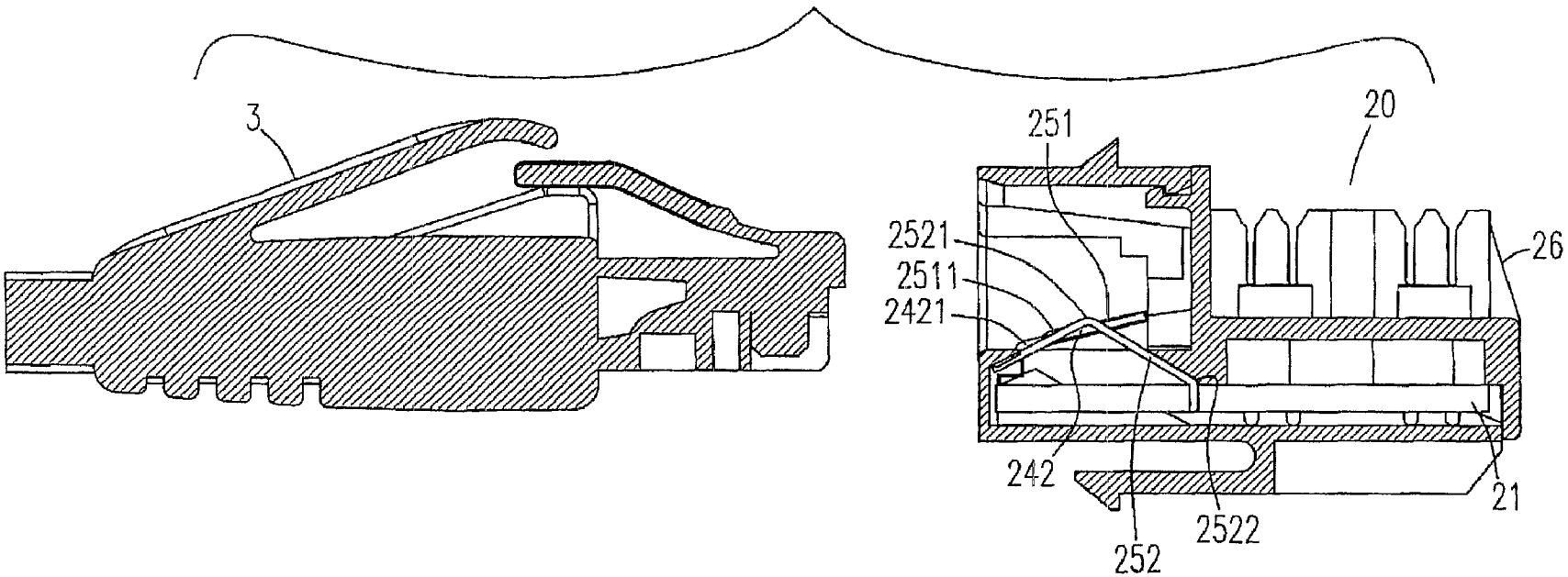
FIG. 7(B) is a diagram showing a sectional view of the assembling of the network jack and an internet plug taken along the broken line D-D' as shown in FIG. 7(A) according to a preferred embodiment of the present application.
Figure 8:
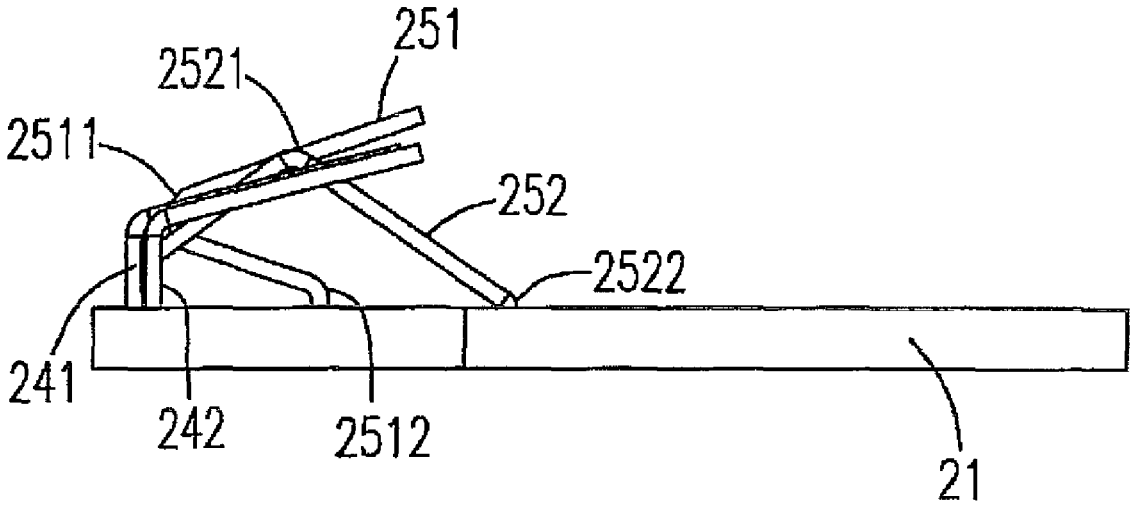
FIG. 8 is a diagram showing the relevant mounting relationship among the sixth contact, the seventh contact and the eighth contact according to a preferred embodiment of the present invention.

Please refer to FIGS. 7(A) and 7(B). FIG. 7(A) is a diagram showing the assembled network jack 20 and the internet plug 3. FIG. 7(B) is a diagram showing a sectional view of the assembled network jack 20 and the internet plug 3, taken along the broken line D-D' as shown in FIG. 7(A). As shown in FIG. 7(B), after the terminal base 26 is assembled with the printed circuit board 21, the eighth contact 252 would have two bending portions 2521 and 2522, the sixth contact 242 would have only one bending portion 2421, and the seventh contact 251 would have bending portions 2511 and 2512, as shown in FIG. 8, which is a diagram showing the relevant mounting relationship among the sixth contact 242, the seventh contact 251 and the eighth contact 252.

Figure 1:
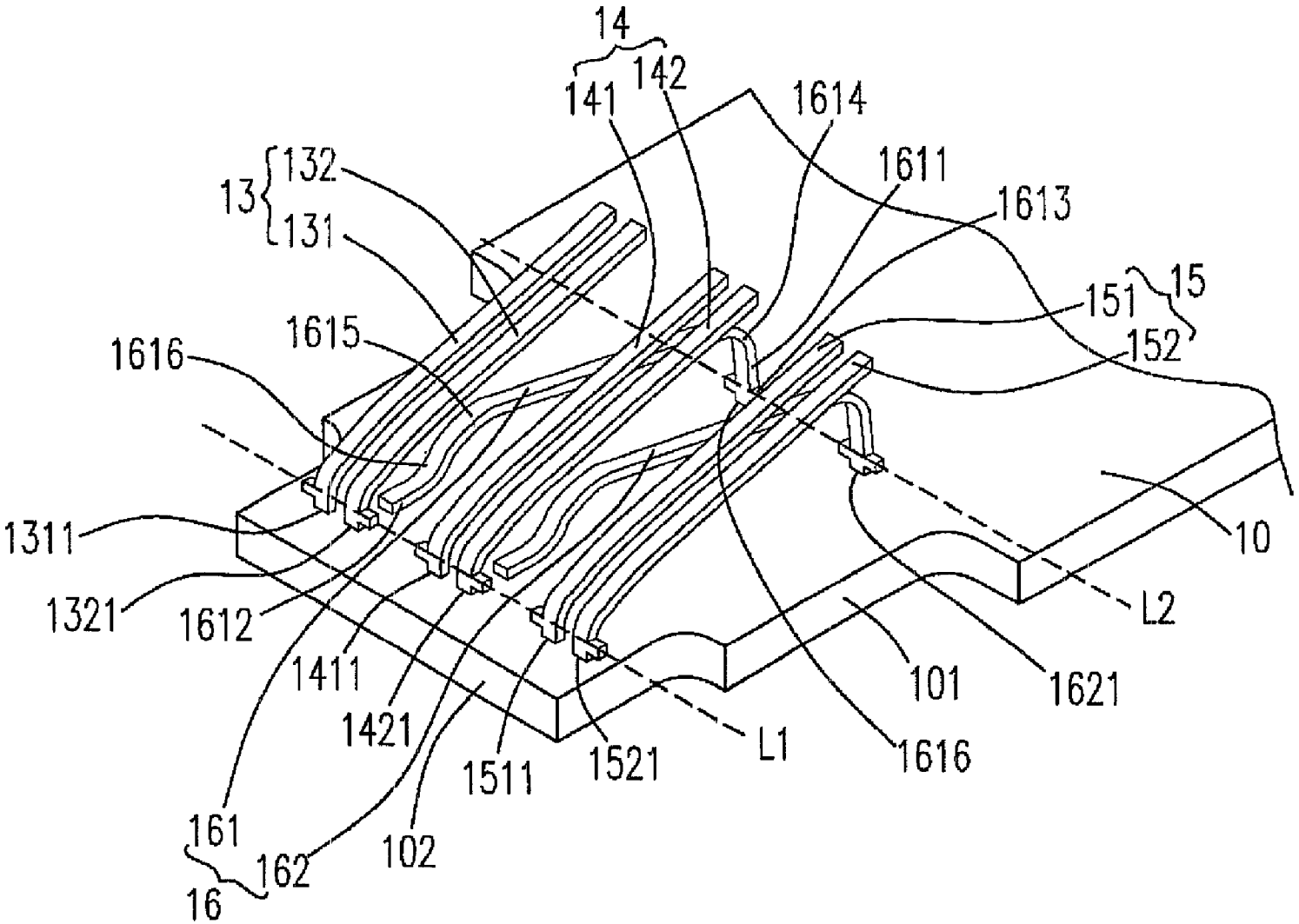
Fig. 1 (PRIOR ART)
FIG. 1 shows a diagram of the circuit board in the prior art.

Please refer to FIGS. 1, 5 and 7, in the prior art, U.S. Pat. No. 6,749,466, there is no supporting structure for the contacts 131, 132, 141, 142, 151, 152, 161 and 162, so that the relevant durabilities are not so good when connected with an internet plug. Nevertheless, in the present application, the contact frame 261 could provide the support to the contacts 231, 232, 241, 242, 251, 252, 261 and 262, so that the lifespans of the contacts in the present application are greater than those in the prior art, U.S. Pat. No. 6,749,466.

In the present application, the contacts 221, 222, 231, 232, 241, 242, 251 and 252 are circular, so that their durabilities would be better than the conventional rectangular contacts, the contacts could provide the transmission with less crosstalk noise and the contacts could have nice telecommunication properties. In addition, it is to be noted that no push manufacturing process would become simple and the cost could be saved. The first, second, third and fourth contacts 221, 222, 231 and 242 of the present application are made of phosphor bronze with 3.5%-10% stannum and 0.01%-1% phosphor by weight. The phosphor bronze is easily molded and there is 50 micro-inch aurum coated thereon. Since the circular contact has a better flexibility than that of the rectangular contact, which is the shape of the contact in U.S. Pat. No. 6,749,466, the contact of the present could be made by phosphor bronze instead of the expensive beryllium copper and then have the desired stress response. Since the cost of the phosphor bronze is less than that of the beryllium copper, the producing cost of the present network jack is less than that of the prior art.

Figure 9:
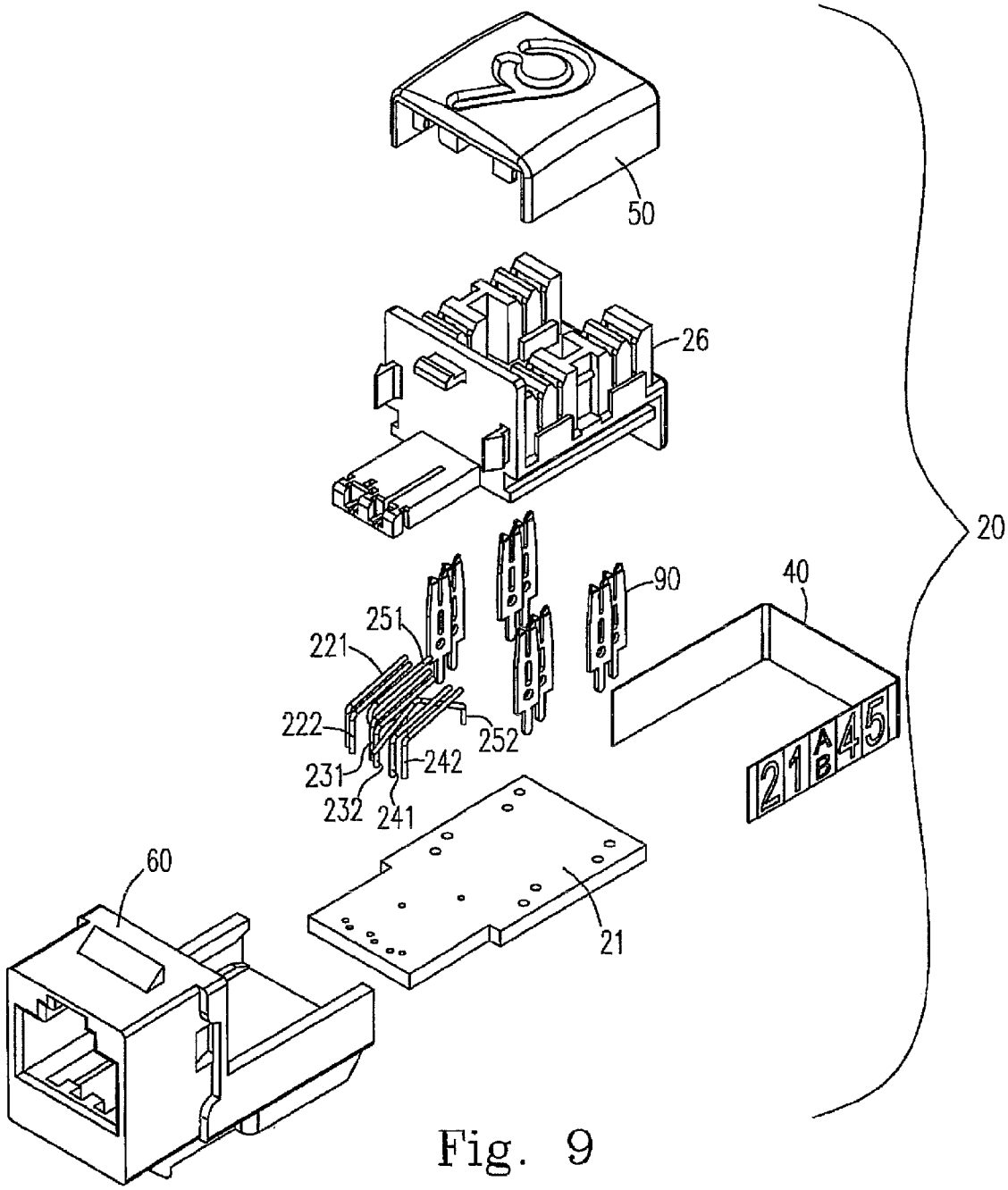
FIG. 9 is the explosive diagram of the network jack according to an embodiment of the present application.
Figure 10:
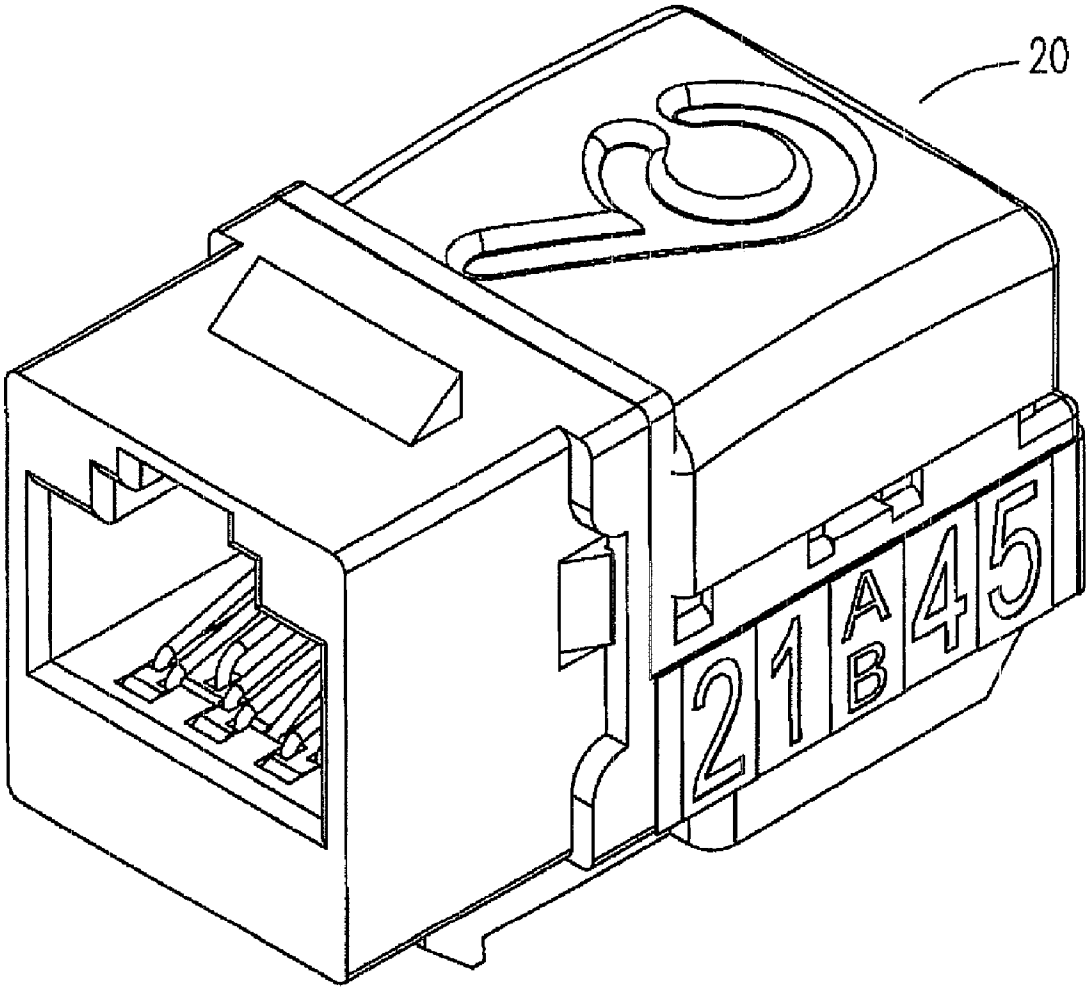
FIG. 10 is the appearance of the network jack according to the embodiment of the present application.

Please refer to FIGS. 9 and 10, which are the explosive diagram of the network jack according to an embodiment of the present application and the appearance of the network jack according to an the embodiment of the present application. As shown in FIG. 9, the network jack 20 includes the printed circuit board 21, the contacts 221, 222, 231, 232, 241, 242, 251 and 252, the chips 90, the terminal base 26, the plug portion 60, the cover 50 and the wiring map 40.

In order to further illustrate the changes of the seventh contact 251 and the eighth contact 252 during assembling, the different side views of the network jack are provided.

Figure 11:
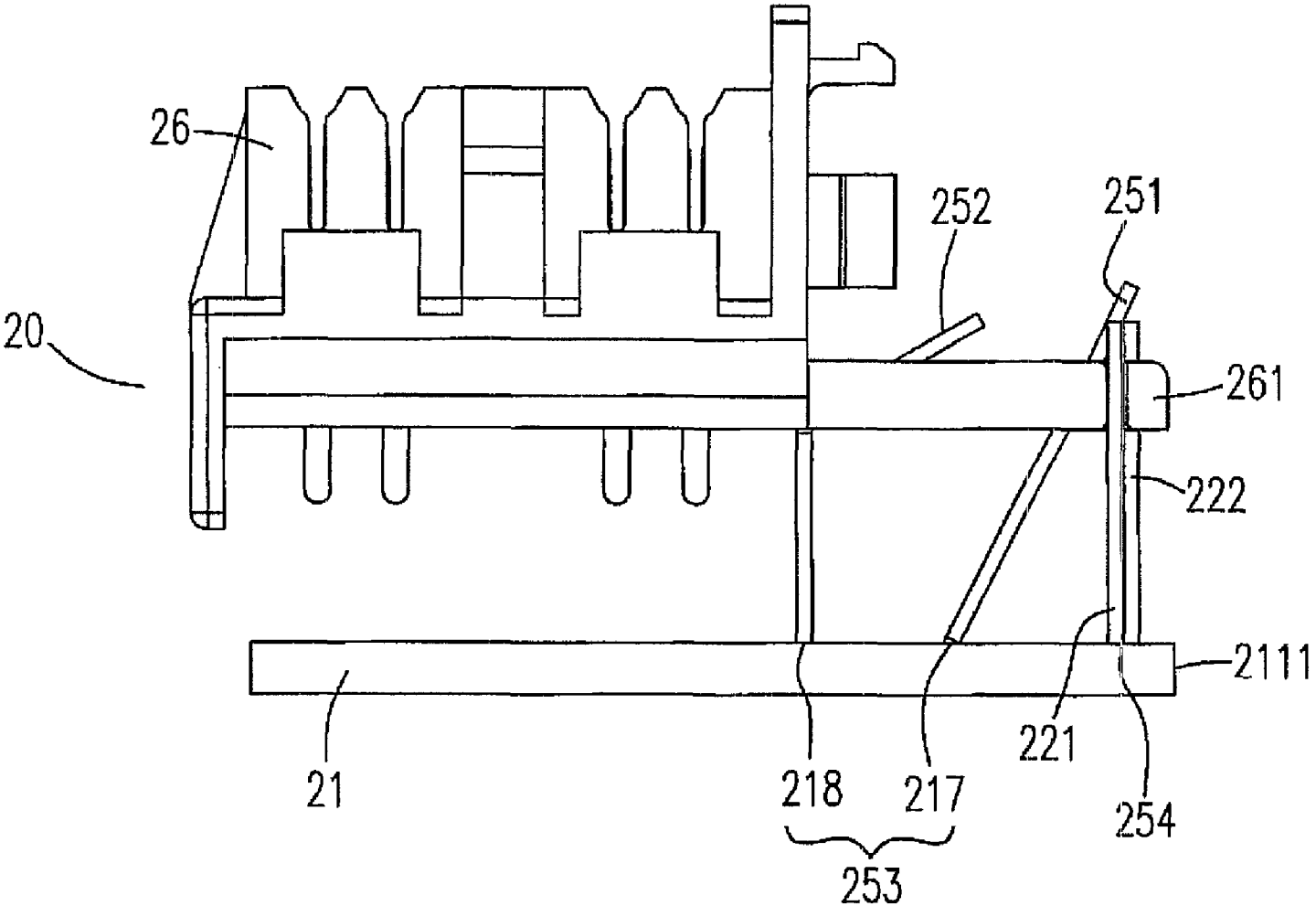
FIGS. 11 and 12 are the diagrams showing the assembling process of the circuit board and the terminal base according to a further preferred embodiment of the present invention.
Figure 12:
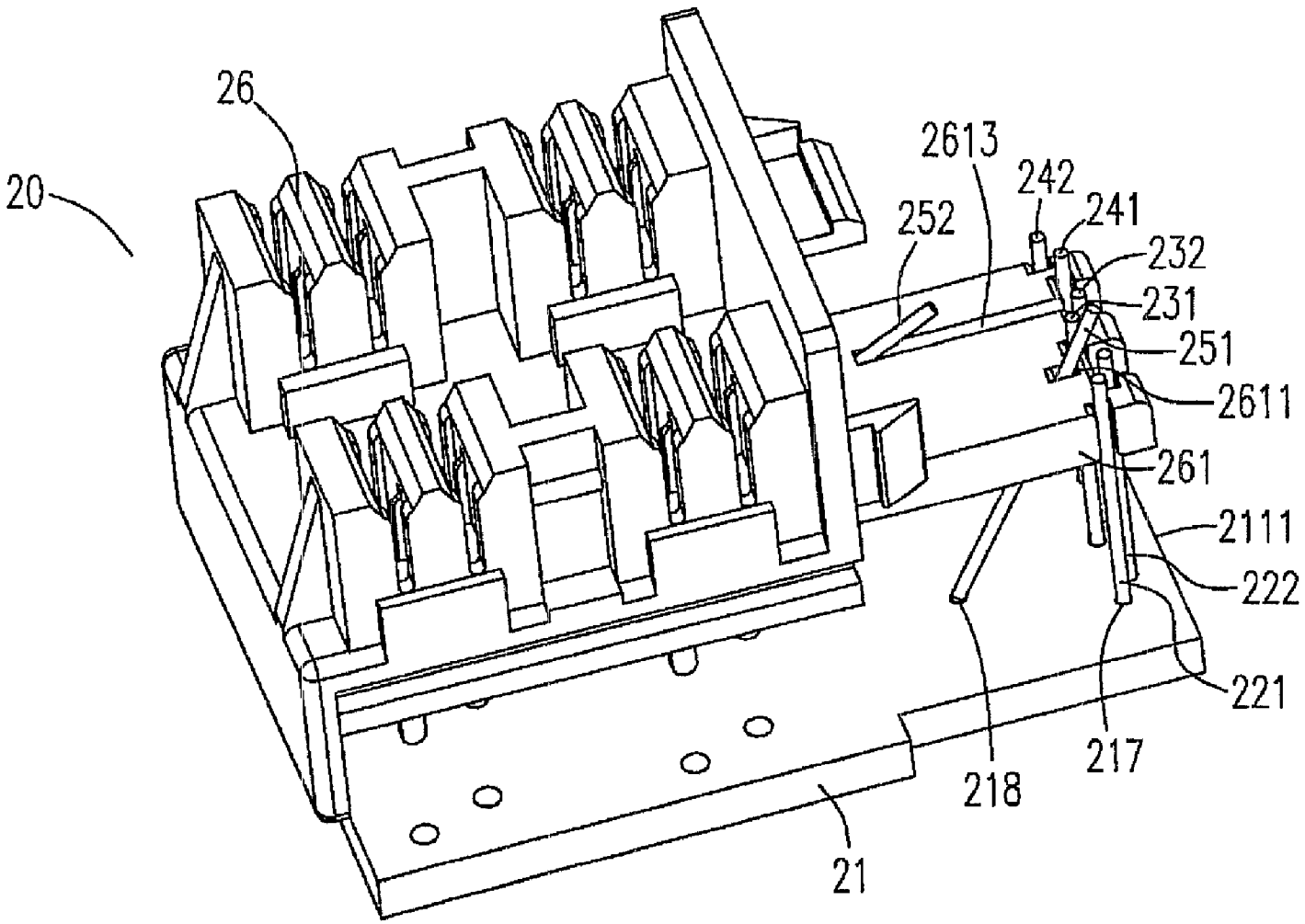

Please refer to FIGS. 11 and 12, which are the diagram showing the assembling process of the circuit board and the terminal base according to a preferred embodiment of the present invention. The network jack 20 includes the printed circuit board 21 and the terminal base 26 having a contact frame 261. The contact frame 261 has a through 2613 and an opening 2611. The printed circuit board 21 has two groups of contacting areas 254 and 253. The first group of contacting areas 254 includes three pairs of location points, the first to sixth location points 211-216 shown FIG. 3, arranged along the side 2111 of the printed circuit board 21. The second group of contacting areas 253 includes the seventh location point 217 and the eighth location point 218. The distance between the seventh location point 217 and the side 2111 of the printed circuit board 21 is different from that between eighth location point 218 and the side 2111 of the printed circuit board 21.

Figure 13A:
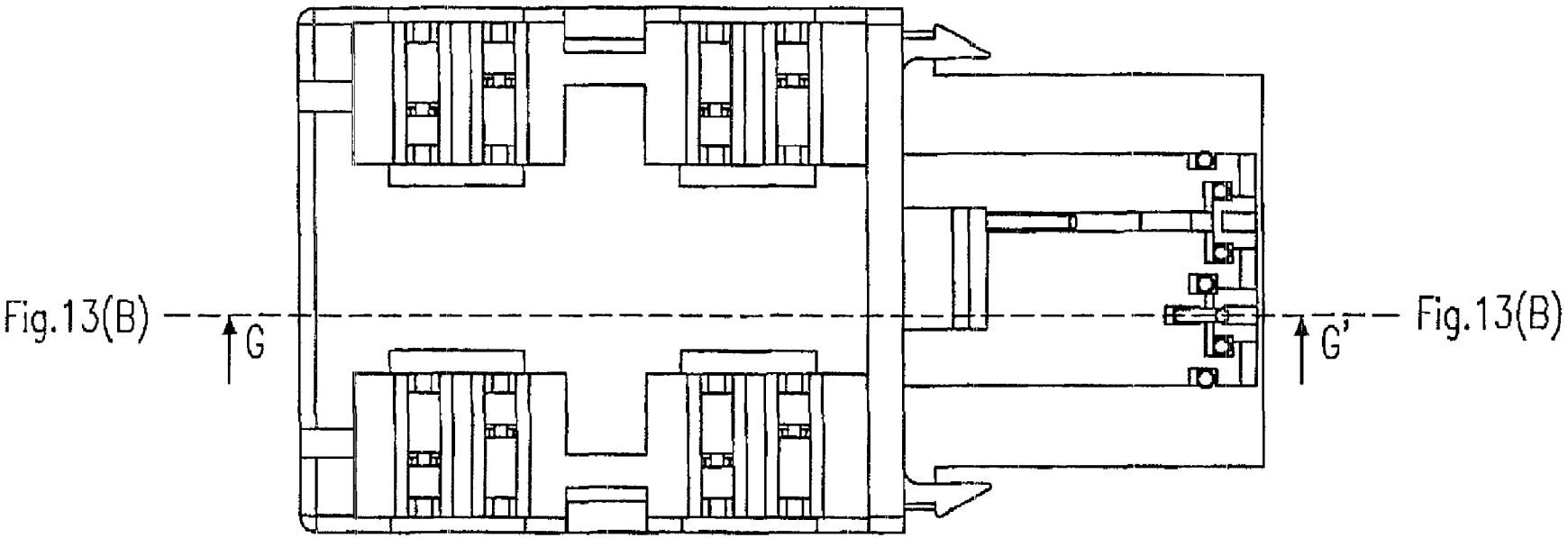
FIG. 13(A) is a top view of the network jack shown in FIG. 11 during the assembling process according to the preferred embodiment of the present invention.

Please refer to FIG. 13(A), which is a top view of the network jack shown in FIG. 11 during the assembling process according to the preferred embodiment of the present invention.

Figure 13B:
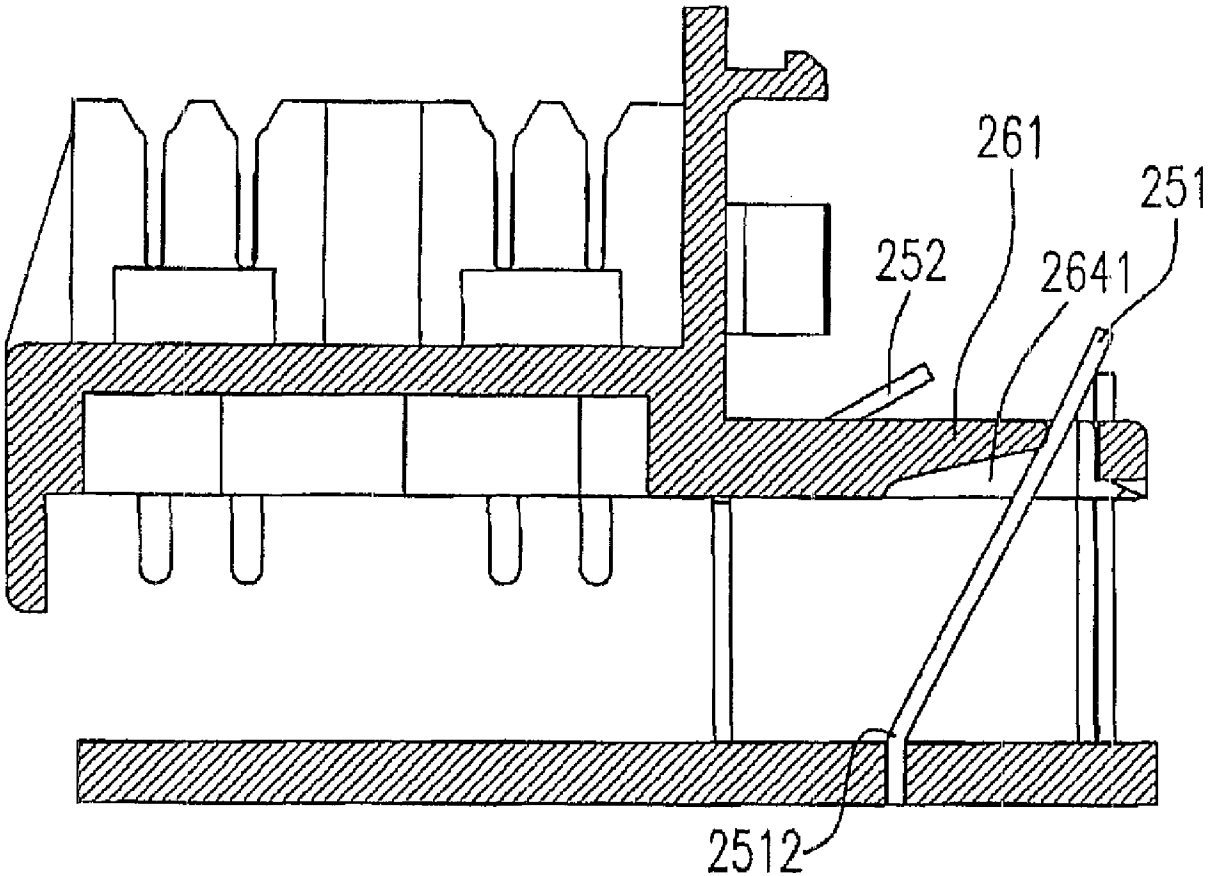
FIG. 13(B) is a sectional drawing of the network jack along the G-G' line shown in FIG. 13(A)

Please refer to FIG. 13 (B), which is a sectional drawing of the network jack along the G-G' line shown in FIG. 13(A). As shown in FIG. 13, the seventh contact 251 passes through the opening 2641, and has a bending 2512.

After further assembling the printed circuit board 21 with the terminal base 26, the shapes of the seventh and eighth contacts 251 and 252 are further changed.

Figure 14A:
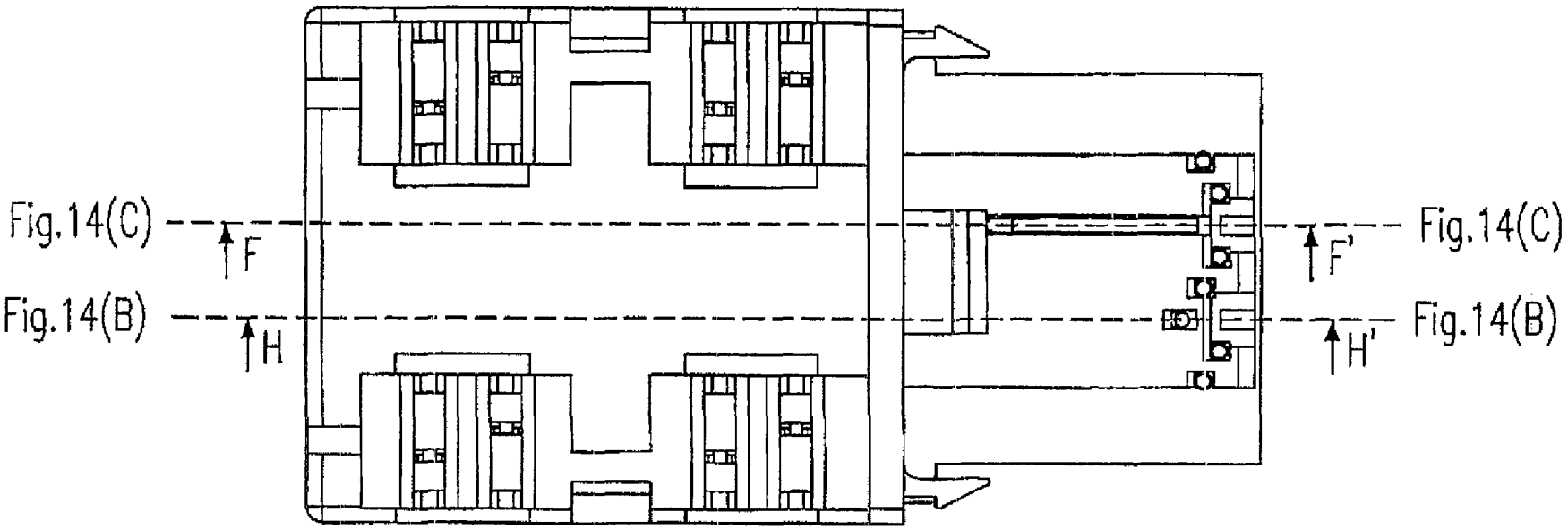
FIG. 14(A) is a top view of the network jack after a further assembling according to the preferred embodiment of the present invention.

Please refer to FIG. 14(A), which is a top view of the network jack after a further assembling according to the preferred embodiment of the present invention.

Figure 14B:
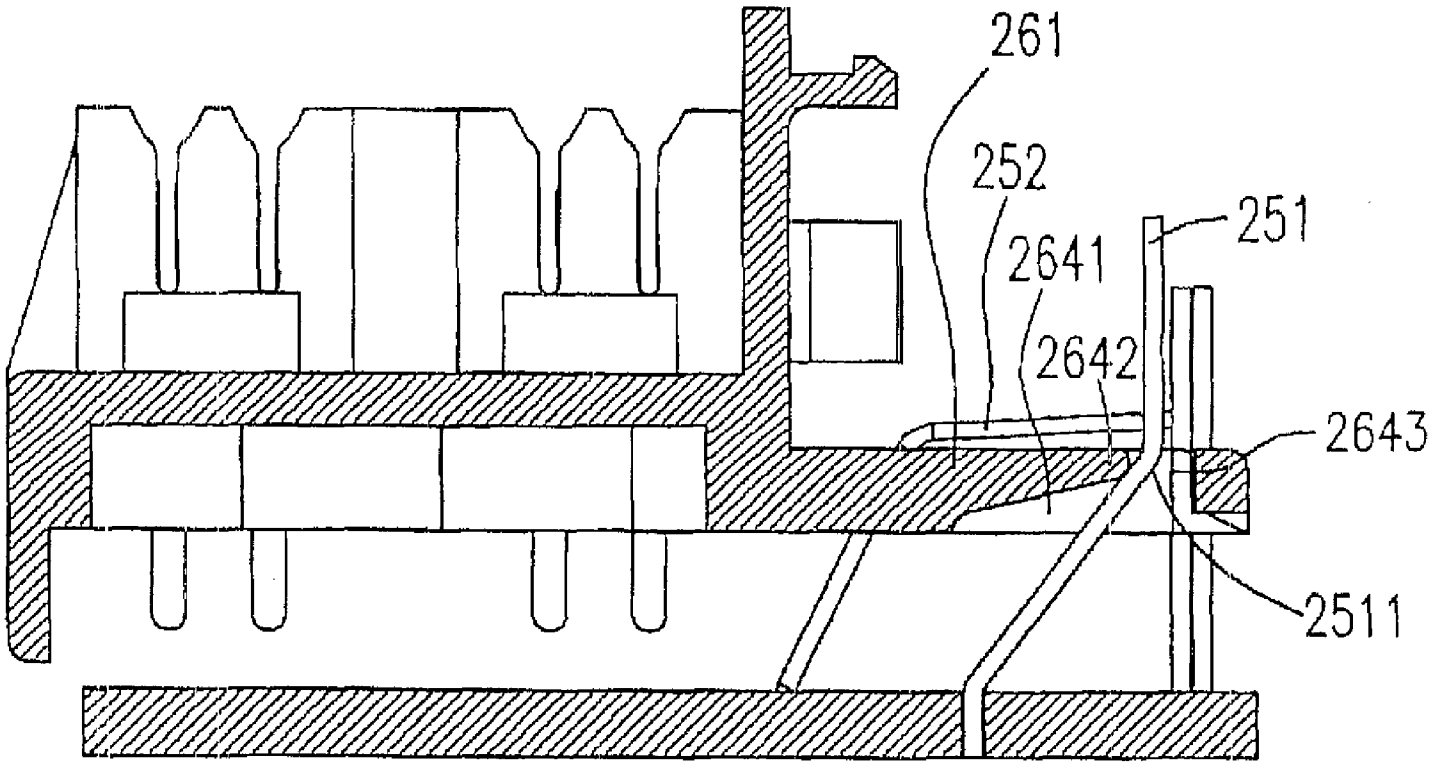
FIG. 14(B) is a sectional drawing of the network jack along the G-G' line shown in FIG. 14(A)

Please refer to FIG. 14(B), which is a sectional diagram of the network jack along the G-G' line shown in FIG. 14(A). As shown in FIG. 14(B), the contact frame 26 includes a protrusion 2642 and a stop surface 2643. During the assembling process, the contact 251 would pass through the opening 2641 and form the bending portion 2511 by the protrusion 2642 and the stop surface 2643.

Figure 14C:
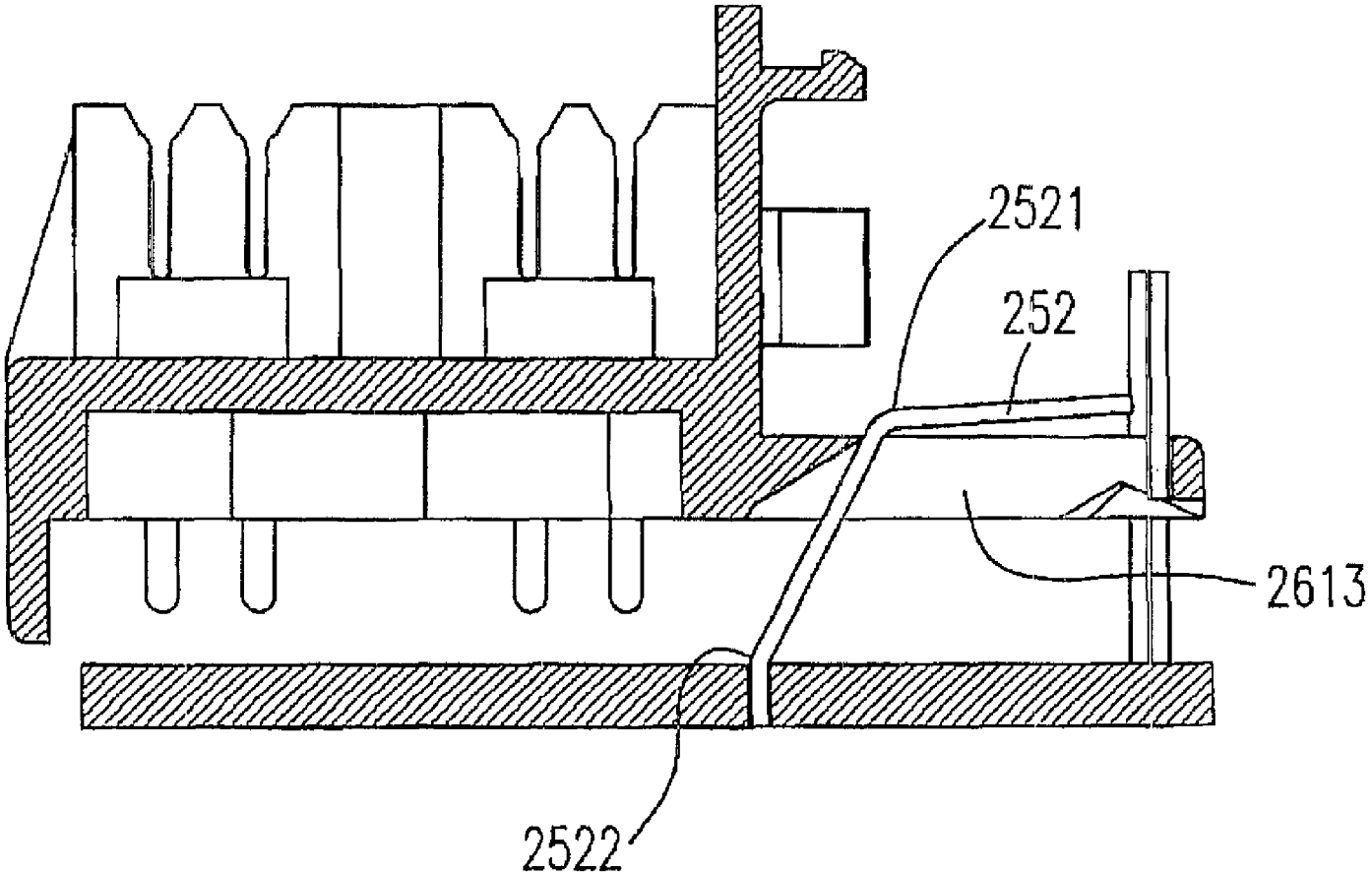
FIG. 14(C) is a sectional drawing of the network jack along the F-F' line shown in FIG. 14(A)
Figure 15:
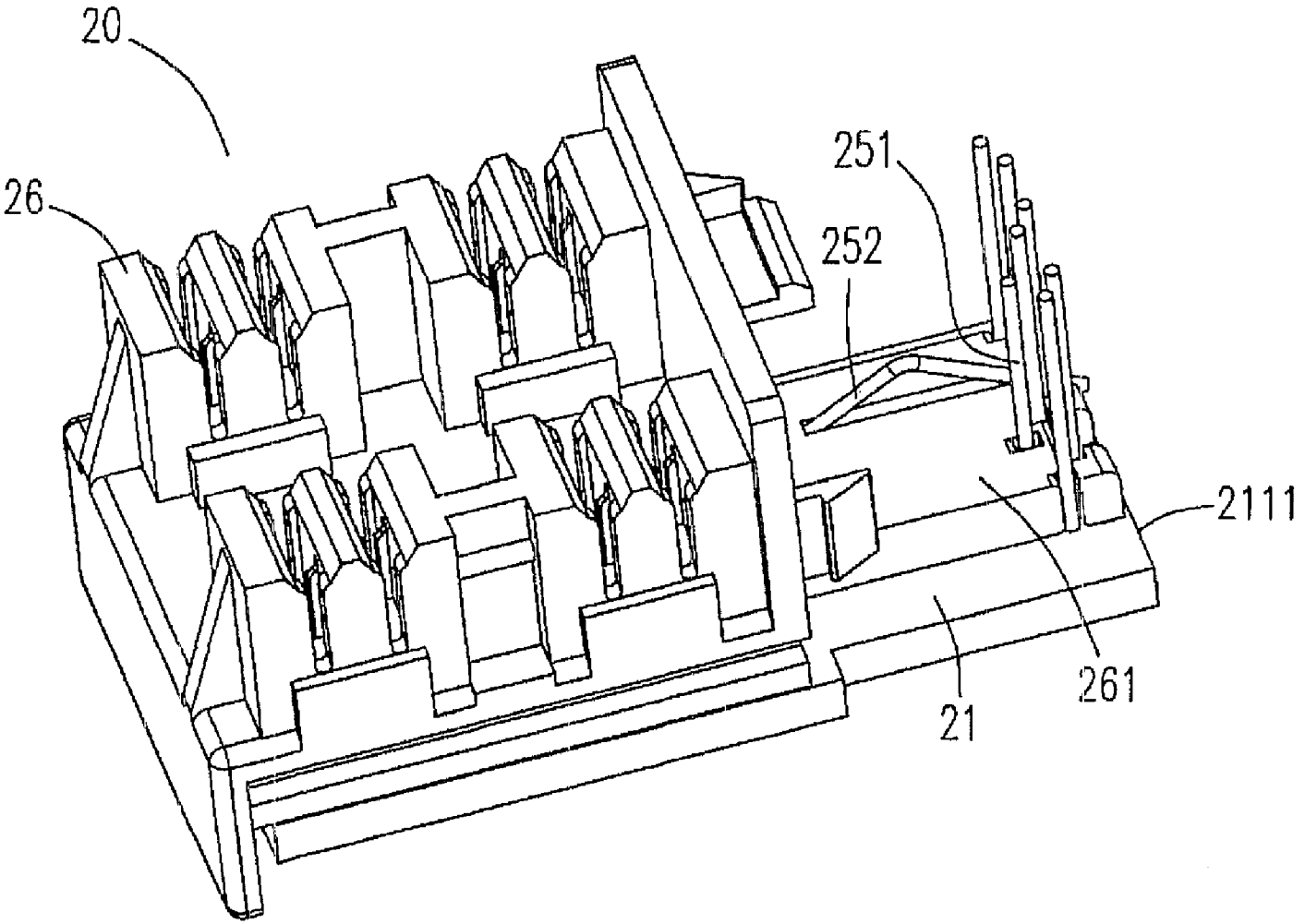
FIG. 15 is the diagram showing a network jack according to the preferred embodiment of the present invention.

Please refer to FIG. 14(C), which is a sectional diagram of the network jack along the F-F' line shown in FIG. 14(A). As shown in FIG. 14(C), the contact frame 261 includes the tunnel 2613 containing the eighth contact 252. After assembling the terminal base 26 and the printed circuit board 21, the eighth contact 252 would have the bending portion 2521 and 2522 by the contact frame 261. In addition, FIG. 15 shows the diagram of the network jack 20 after the terminal base 26 is assembled to the printed circuit board 21. As shown in FIG. 15, the seventh and eighth contacts 251 and 252 would have different directions and have different distances from the side 2111 of the printed circuit board 21.

Figure 16A:
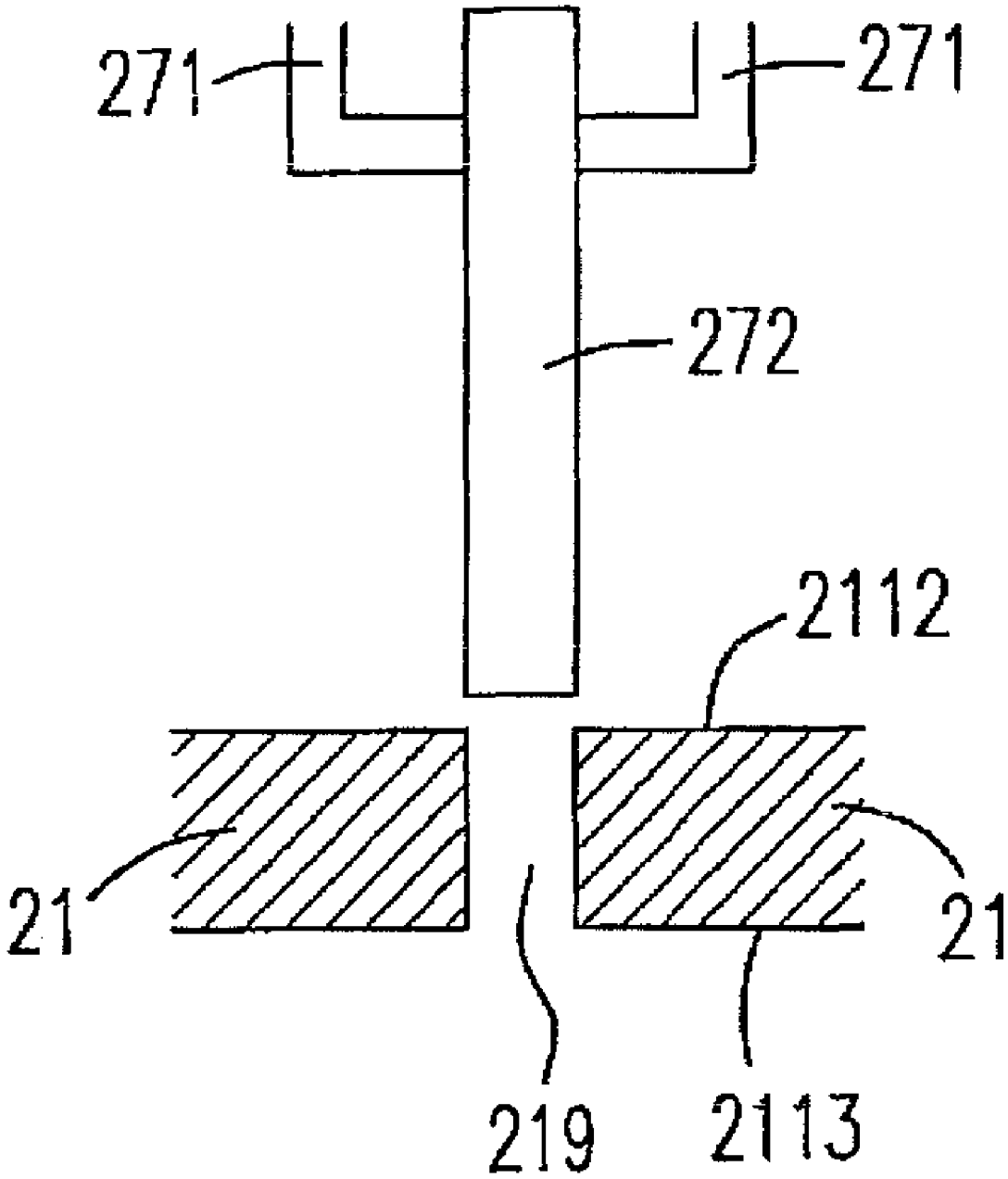
FIGS. 16(A) to 16(D) are the diagrams showing the process of the contacts of the network jack being fixed on the circuit board.
Figure 16B:
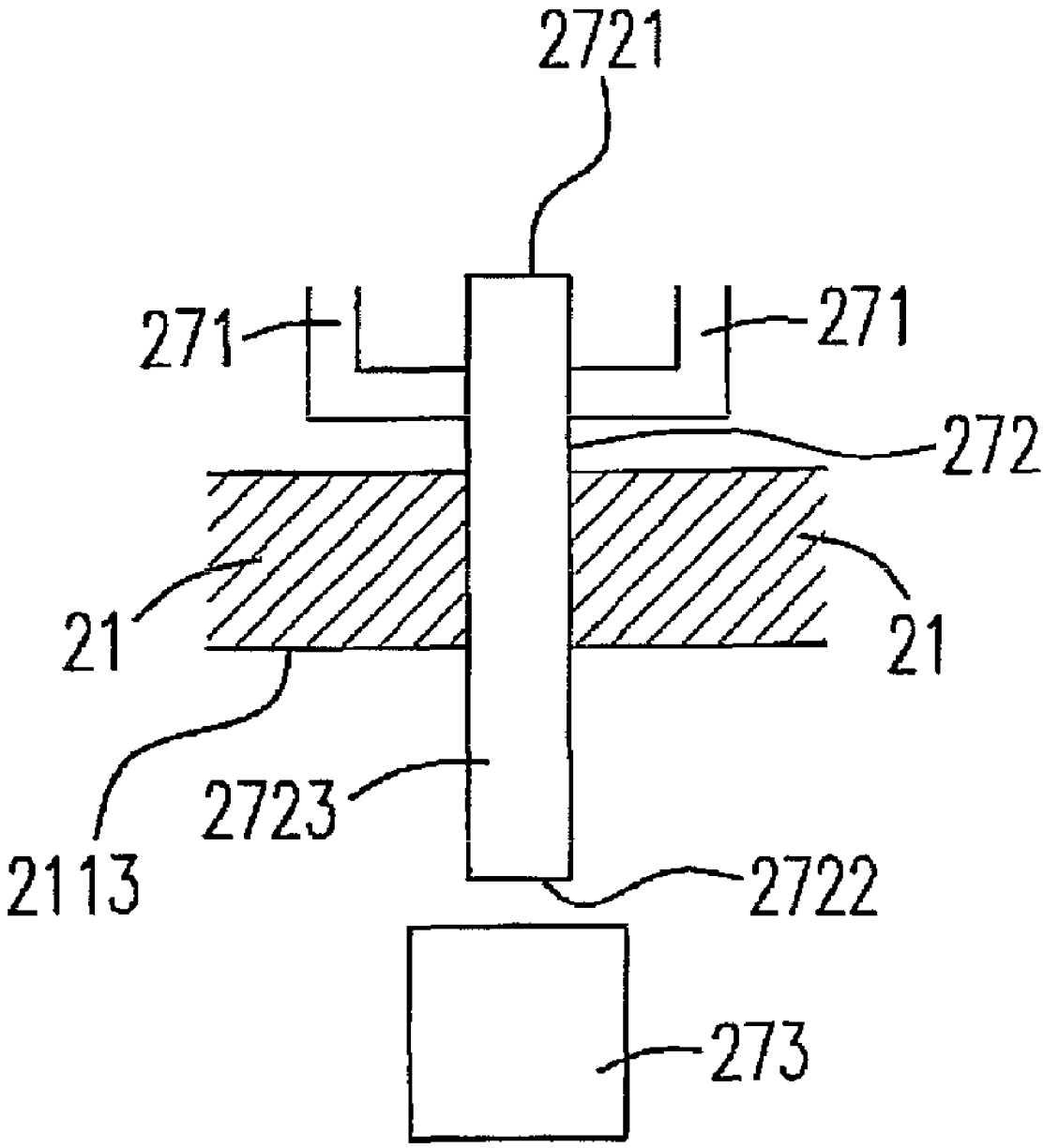
Figure 16C:
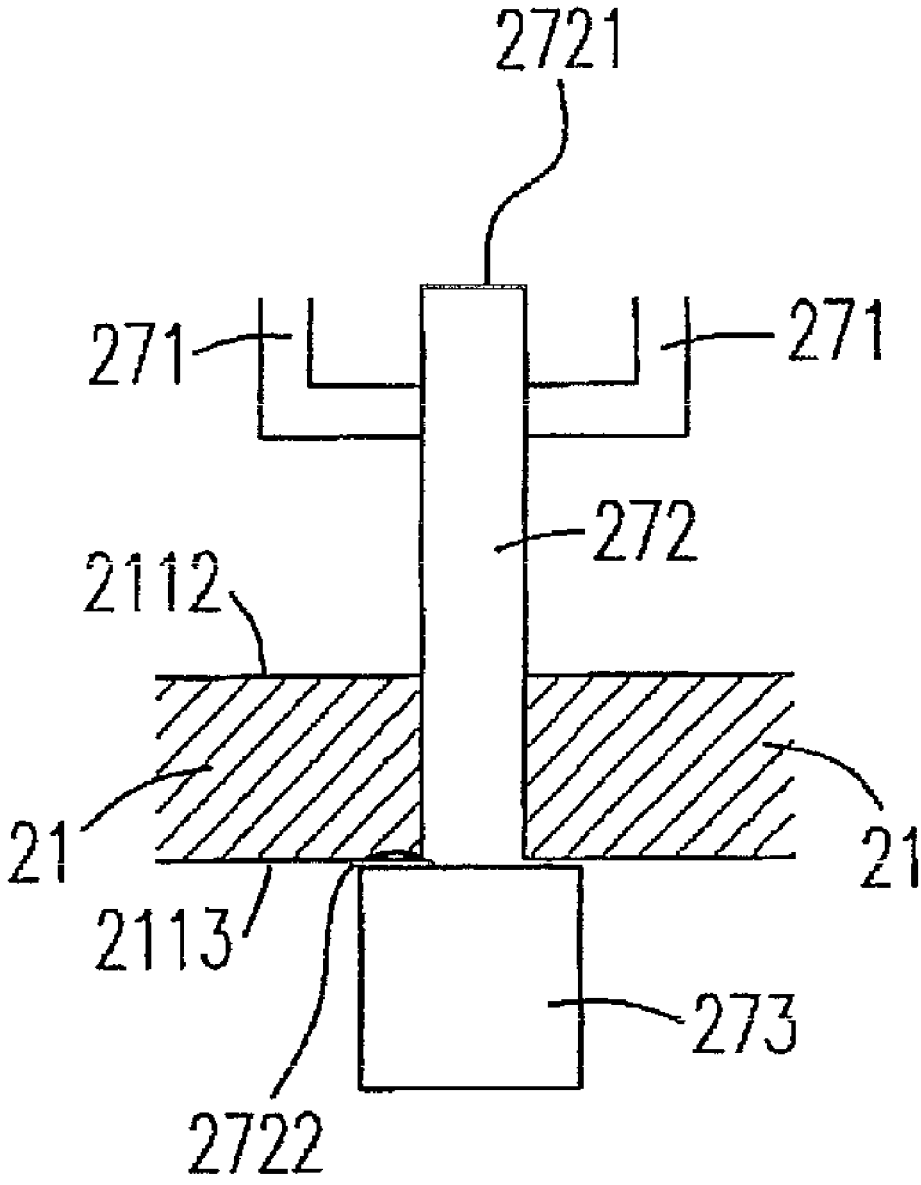
Figure 16D:
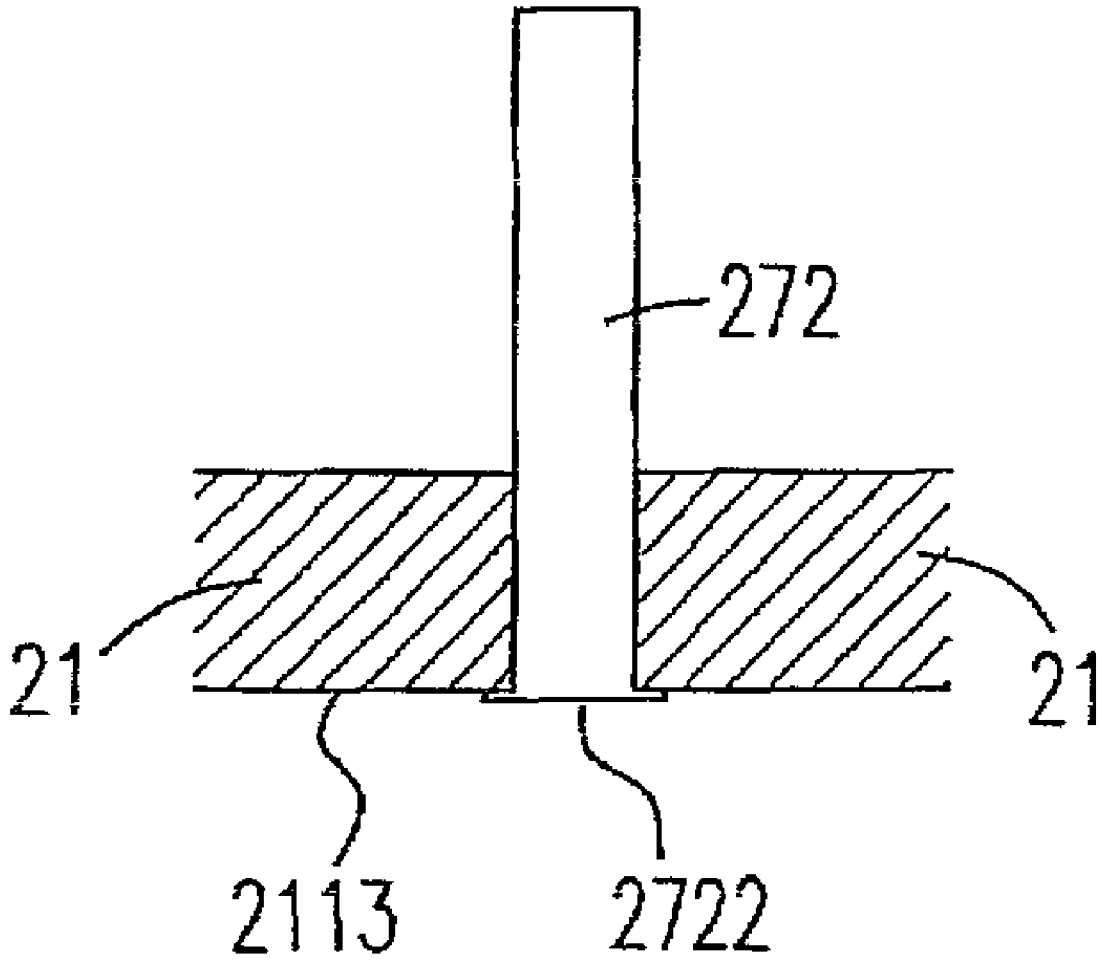

Please refer to FIGS. 16(A) to 16(D), which are the diagrams showing how the contacts of the network jack of the present invention are fixed on the circuit board. As shown in FIG. 16(A), the holding device 271 catches the contact 272 which will be fixed to the printed circuit board 21 through the opening 219. The opening 219 can refer to any one of the location points 211-218 or be located at any appropriate position on the printed circuit board 21. As shown in FIG. 16(B), the contact 272 has an upper end 2721 and the lower end 2722, and the contact 272 is inserted into the printed circuit board 21, i.e. the opening 219, by the holding device 271 from the upper surface 2112 toward the lower surface 2113. After the inserting process, the portion 2723 of the contact 272 will protrude from the lower surface 2113. As shown in FIG. 16(C), the protruded portion 2723 will be stressed with an upper force so that the contact 272 will be upward inserted through the opening 219 from the lower surface 2113 toward the upper surface 2112. Preferably, the upper force is provided by the punch 273 punching the lower end 2722 of the contact 272, which is a riveting process. By the riveting process, the lower end 2722 of the contact 272 will have a conformation change and the contact 272 will be fixed to the printed circuit board 21 as shown in FIG. 16(D).

Figure 17A:
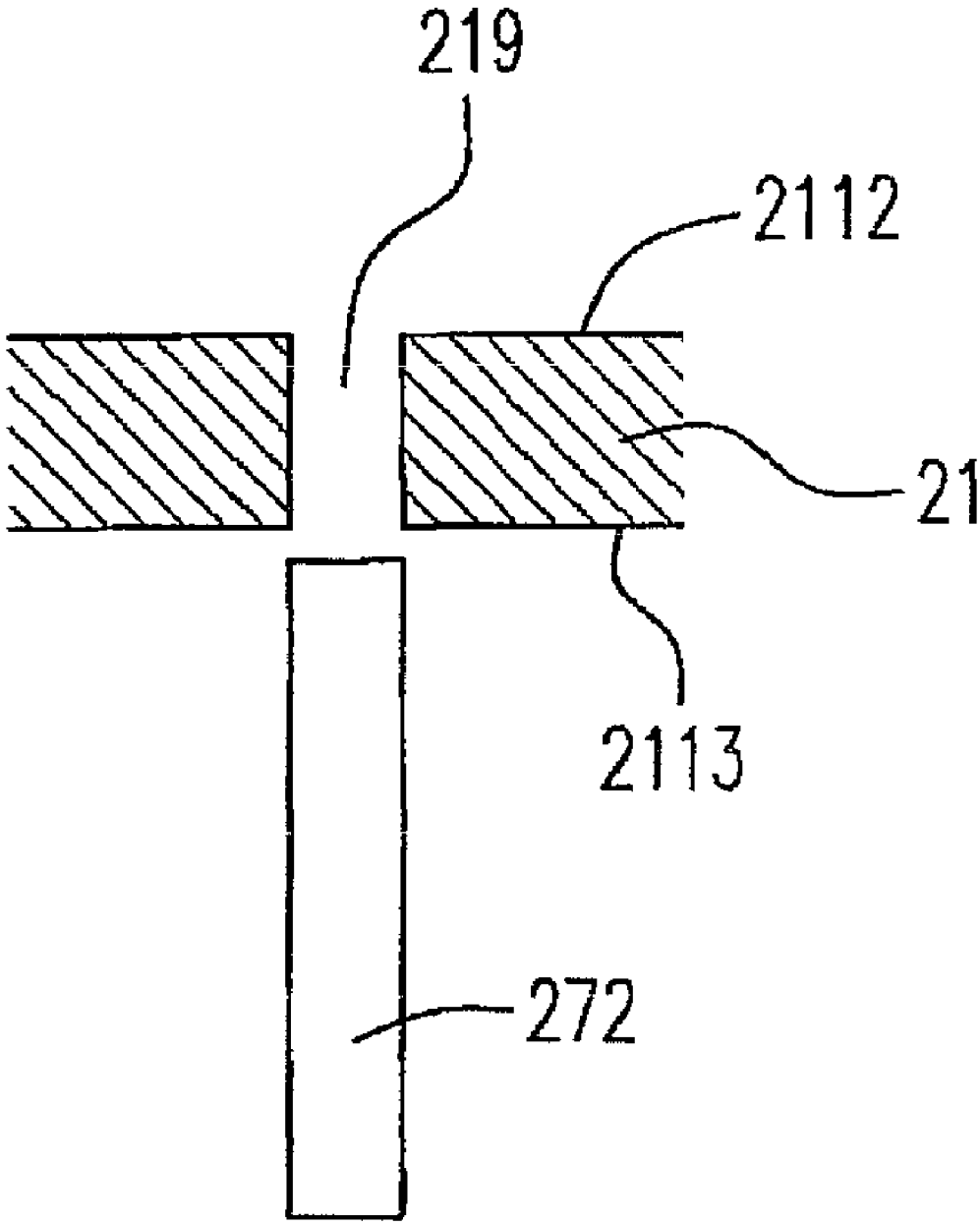
FIGS. 17(A) to 17(D) are the diagrams showing the process of the contacts of the network jack being fixed on the circuit board.
Figure 17B:
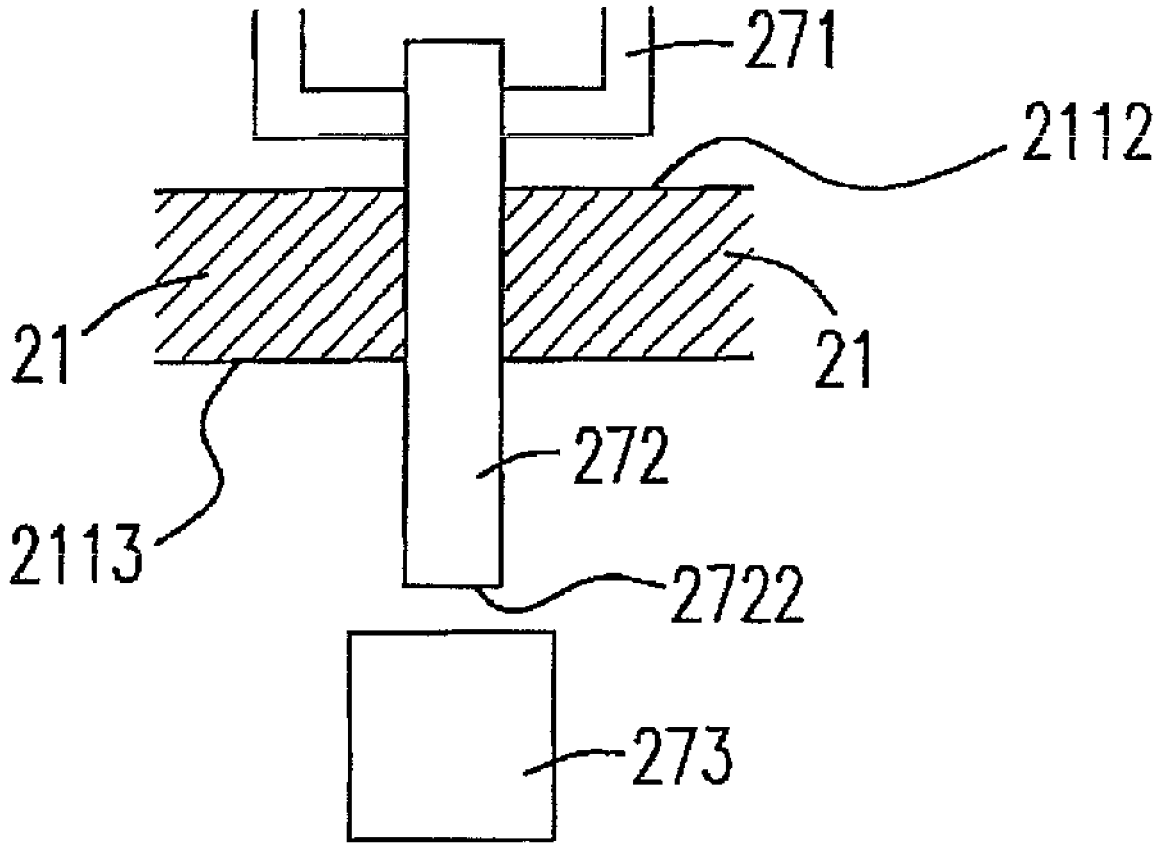
Figure 17C:
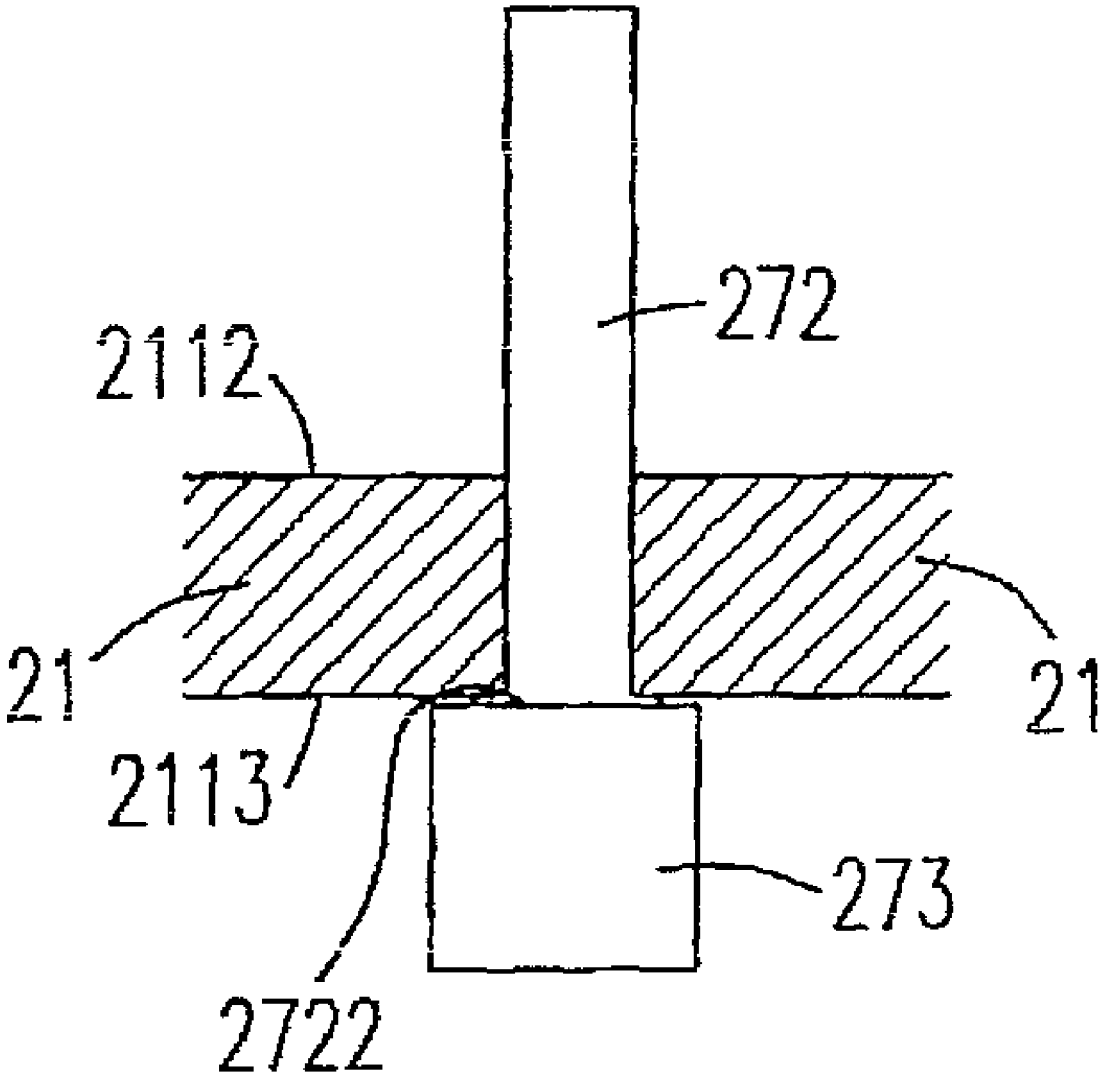
Figure 17D:
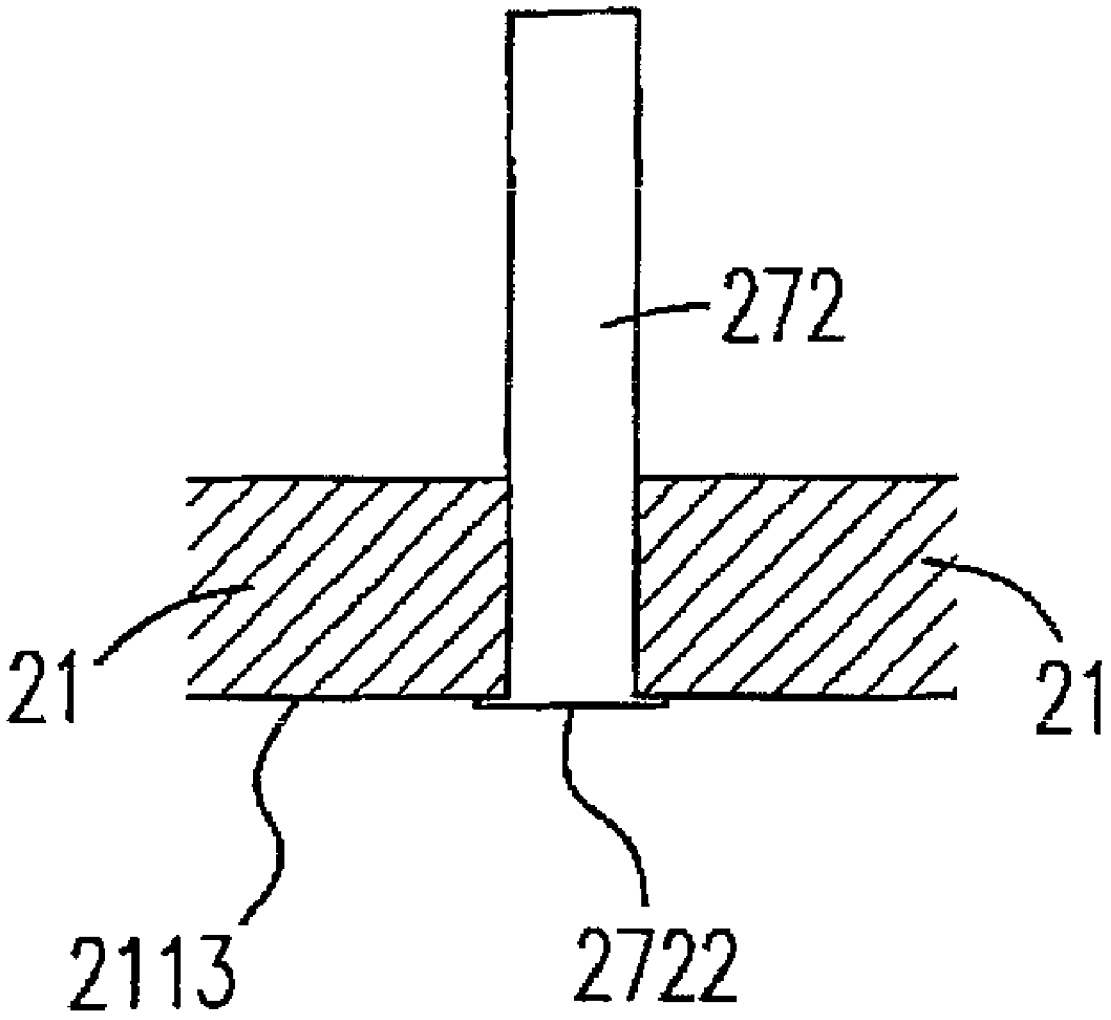

In another embodiment, the contact 272 is upward inserted into the opening 219 of the printed circuit board 21 from the lower face 2113 toward the upper surface 2112 as shown in FIGS. 17(A) to 17(B). Then the upper force stressed on the lower end 2722 is also provided by the punch 273 so that the contact 272 will be fixed to the printed circuit board 21 as shown in FIGS. 17(C) to 17(D). In addition, the holding device 271 can be applied in the riveting process of the embodiment shown in FIGS. 17(B) to 17(D) to provide an additional support and/or a reacting force for the contact 272 during the riveting process. The fixed contacts can further be processed by the bending procedures as above-mentioned embodiments of the present invention.

In view of aforesaid discussions, the present invention provides a network jack having a circuit board with a contact pair parallel to another contact pair, a terminal base able to bend contacts during the assembling of the terminal base and the circuit board, and a contact frame able to bend the contacts during the assembling of the plug portion and the terminal base. In addition, the present invention also provides a network jack having two groups of contacts, where the first group contacts are arranged along a side of the network jack and the respective distances between each of the second group contacts and the side of the network jack are various. Since the present network jack and the relevant manufacturing method are able to overcome the drawbacks of the conventional network jack, such as the narrow operating voltage range, the high cost, the complex manufacturing process and the delicate assembling required, the present invention is extremely suitable for being used in the industrial production.

Moreover, since fixing the contract into the circuit board of the present invention needs no additional supports by additionally configuring any element, e.g. the push foot mechanism or the lateral protrusion, on the contact, the present invention is clearly advantageous over the conventional network jack. Further, the contacts of the present invention are directly bent by the acting portion which has an immobile structure so that the bending of the contacts is easily and accurately controlled. Through such distinguishable features, the fixing process while manufacturing the network jack not only could be substantially simplified, but also the manufacturing costs could be decreased accordingly.

While the invention has been described in terms of what is presently considered to be the most practical and preferred embodiment, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A method for manufacturing a network jack, comprising the steps of:

a) providing a circuit board for the network jack and having a first side, a plurality of first contacting areas along the first side, a plurality of second contacting areas and an upper and a lower surfaces, wherein the plurality of first contacting areas are located between the plurality of second contacting areas and the first side;

b) using a first riveting process to upwardly configure a plurality of first contacts into the plurality of first contacting areas from the lower surface toward the upper surface to protrude the first contacts from the upper surface; and c) using a second riveting process to upwardly configure a plurality of second contacts into the plurality of second contacting areas from the lower surface to the upper surface to protrude the second contacts from the upper surface.

2. A method according to claim 1, wherein the first side and each of the plurality of second contacting areas have a respective distance therebetween and the respective distances different from one another.

3. A method according to claim 1 further comprising a step d) of bending the second contacts to make each of which have at least one bend.

4. A method according to claim 3, wherein the second contacts are bent toward respective directions being different from one another.

5. A method according to claim 1 further comprising a step d) of mounting an assembly on the circuit board for bending the second contacts to make each of which have at least a specific direction.

6. A method according to claim 1 further comprising a step d) of bending the first contacts.

7. A method according to claim 1, wherein the first and second contacts contact with an external plug.

8. A method for manufacturing a network jack with a circuit board, comprising steps of:

a) providing the circuit board having a first side, plural first contacting areas along the first side, plural second contacting areas and an upper and a lower surfaces, wherein the plural first contacting areas are located between the first side and the plural second contacting areas, and plural distances between the first side and each of the plural second contacting areas are various;

b) forming first bendable contacts on the plural first contacting areas by using a first riveting process to upwardly configure the first bendable contacts into the plural first contacting areas from the lower surface toward the upper surface to protrude the first bendable contacts from the upper surface;

c) forming second bendable contacts on the plural second contacting areas by using a second riveting process to upwardly configure the second bendable contacts into the plural second contacting areas from the lower surface to the the upper surface to protrude the second bendable contacts from the upper surface; and d) bending each of the second bendable contacts by assembling an acting portion on the circuit board to make the second bendable contacts have at least two arranged directions, wherein the first bendable contacts and the second bendable contacts contact with an external plug and are fixed to the circuit board of the network jack by the first and the second riveting processes.

* * * * *